US009035532B2

(12) United States Patent
Chowdhury

(10) Patent No.: US 9,035,532 B2
(45) Date of Patent: May 19, 2015

(54) ULTRASONIC SENSOR MICROARRAY AND METHOD OF MANUFACTURING SAME

(71) Applicant: UNIVERSITY OF WINDSOR, Windsor (CA)

(72) Inventor: Sazzadur Chowdhury, Windsor (CA)

(73) Assignee: UNIVERSITY OF WINDSOR, Windsor (CA)

( * ) Notice: Subject to any disclaimer, the term of this patent is extended or adjusted under 35 U.S.C. 154(b) by 269 days.

(21) Appl. No.: 13/804,279

(22) Filed: Mar. 14, 2013

(65) Prior Publication Data

US 2014/0125193 A1 May 8, 2014

Related U.S. Application Data

(60) Provisional application No. 61/721,806, filed on Nov. 2, 2012, provisional application No. 61/724,474, filed on Nov. 9, 2012.

(51) Int. Cl.
*B06B 1/02* (2006.01)

(52) U.S. Cl.
CPC ..... *B06B 1/0292* (2013.01)

(58) Field of Classification Search
USPC ..... 310/300, 308–309, 311; 367/181, 367/153–154
See application file for complete search history.

(56) References Cited

U.S. PATENT DOCUMENTS

| | | | | |
|---|---|---|---|---|
| 6,632,178 | B1 * | 10/2003 | Fraser | 600/459 |
| 6,942,750 | B2 | 9/2005 | Chou | |
| 7,545,012 | B2 * | 6/2009 | Smith et al. | 257/416 |
| 7,545,075 | B2 * | 6/2009 | Huang et al. | 310/309 |
| 7,612,483 | B2 * | 11/2009 | Degertekin | 310/309 |
| 7,670,290 | B2 * | 3/2010 | Hossack et al. | 600/437 |
| 7,781,238 | B2 | 8/2010 | Wodnicki | |
| 7,839,722 | B2 * | 11/2010 | Wagner et al. | 367/181 |
| 7,923,795 | B2 * | 4/2011 | Kobayashi et al. | 257/416 |
| 2011/0084570 | A1 * | 4/2011 | Soeda et al. | 310/300 |
| 2011/0163630 | A1 * | 7/2011 | Klootwijk et al. | 310/300 |
| 2011/0309716 | A1 * | 12/2011 | Jenninger et al. | 310/300 |
| 2014/0084747 | A1 * | 3/2014 | Lovera-Prieto et al. | 310/300 |

OTHER PUBLICATIONS

Design of a MEMS Discretized Hyperbolic Paraboloid Geometry Ultrasonic Sensor Microarray, IEEE Transactions . . . And Frequency Control, vol. 55, No. 6, Jun. 2008.

Capacitive micromachined ultrasonic transducer (CMUT) arrays for medical imaging, Caronti et al., Microelectronics Journal, vol. 37, pp. 770-777, Dec. 13, 2005.

* cited by examiner

*Primary Examiner* — Thanh Lam

(57) ABSTRACT

A sensor assembly including one or more capacitive micromachined ultrasonic transducer (CMUT) microarray modules which are provided with a number of individual transducers. The microarray modules are arranged to simulate or orient individual transducers in a hyperbolic paraboloid geometry. The transducers/sensor are arranged in a rectangular or square matrix and are activatable individually, selectively or collectively to emit and received reflected beam signals at a frequency of between about 100 to 170 Hz.

28 Claims, 16 Drawing Sheets

Continuous Hyperbolic Paraboloid

ULTRASONIC SENSOR MICROARRAY AND METHOD OF MANUFACTURING SAME

RELATED APPLICATIONS

This application claims the benefit of 35 USC §119(e) to U.S. Patent Application Ser. No. 61/721,806, filed 2 Nov. 2012 and U.S. Patent Application Ser. No. 61/724,474, filed 9 Nov. 2012.

SCOPE OF THE INVENTION

The present invention relates to an ultrasonic sensor microarray and its method of manufacture, and more particularly a microarray which incorporates or simulates a hyperbolic paraboloid shaped sensor configuration or chip. In one preferred construction, the microarray functions as part of a capacitive micromachined ultrasonic transducer (CMUT) based microarray, which is suitable for use in automotive sensor applications, as for example in the monitoring of vehicle blind-spots, obstructions and/or in autonomous vehicle drive and/or parking applications.

BACKGROUND OF THE INVENTION

In the publication *Design of a MEMS Discretized Hyperbolic Paraboloid Geometry Ultrasonic Sensor Microarray*, IEEE Transactions On Ultrasonics, Ferroelectrics, And Frequency Control, Vol. 55, No. 6, June 2008, the disclosure of which is hereby incorporated herein by reference, the inventor describes a concept of a discretized hyperbolic paraboloid geometry beam forming array of capacitive micromachined ultrasonic transducers (CMUT) which is assembled on a microfabricated tiered geometry.

In initial concept, the fabrication of CMUTs has been proposed by a fabrication process in which Silicon-on-Insulator (SOI) wafers were subjected to initial cleaning, after which a 10 nm seed layer of chromium is then deposited thereon using RF-magnetron sputtering to provide an adhesion layer. Following the deposition of the chromium adhesion layer, a 200 nm thick gold layer is next deposited using conventional CMUT deposition processes.

After gold layer deposition, a thin layer of AZ4620 photoresist is spin-deposited on the gold layer, patterned and etched. The gold layer is then etched by submerging the wafer in a potassium iodine solution, followed by etching of the chromium seed layer in a dilute aqua regia, and thereafter rinsing.

The device layer is thereafter etched further to provide acoustical ports for static pressure equalization within the diaphragm, and allowing for $SiO_2$ removal during a release stage.

A top SOI wafer is etched using a Bosch process deep reactive ion etch (DRIE) in an inductively coupled plasma reactive ion etcher (ICP-RIE). After metal etching with the Bosch and DRIE etch, the remaining photoresist is removed by $O_2$ ashing processing. Bosch etched wafer is submerged in a buffer oxide etch (BOE) solution to selectively etch $SiO_2$ without significantly etching single crystal silicon to release the selective diaphragms. Following etching and rinsing, the sensing surfaces (dyes) for each of the arrays are assembled in a system-on-chip fabrication and bonded using conductive adhesive epoxy.

The applicant has appreciated however, existing processes for the fabrication of capacitive micromachined ultrasonic transducers require precise manufacturing tolerances. As a result, the production of arrays of CMUT sensors or transducers on a commercial scale has yet to receive widespread penetration in the marketplace.

SUMMARY OF THE INVENTION

The inventor has appreciated a new and/or more reliable CMUT array design may be achieved by improved manufacturing methods and/or with adjustable operating frequencies. One object of the present invention is to provide an ultrasonic sensor which incorporates one or more CMUT microarrays or modules for transmission of and receiving signals, and which may be more immune to one or more of a variety of different types of ultrasound background noise sources, such as road noise, pedestrian, cyclist and/or animal traffic, car crash sounds, industrial works, power generation sources and the like.

Another object of the invention is to provide an ultrasonic CMUT based microarray which provides programmable bandwidth control, and which allows for CMUT microarray design to be more easily modified for a variety of different sensor applications.

A further object of the invention is to provide an ultrasonic sensor which incorporates a transducer microarray module or sub-assembly which has a substantially flattened curvature, and preferably which has a curvature less than ±10°, and more preferably less than about ±1°, and which in operation simulates a hyperbolic paraboloid shaped chip array geometry.

One aspect of the invention provides a capacitive micromachined ultrasonic transducer (CMUT) based microarray module which incorporates a number of transducers. The microarray module is suitable for use as in vehicle, rail, aircraft and other sensor applications, as for example as part of warning and/or control systems for monitoring blind-spots, adjacent obstructions and hazards, and/or in vehicle road position warning and/or autonomous drive applications.

Another aspect of the invention provides a method for the manufacture of a CMUT based microarray of transducer/sensors, and more preferably CMUT based microarray modules which are operable to emit signals over a number and/or range of frequencies, and which may be arranged to minimize frequency interference from adjacent sensors.

A further aspect of the invention provides a simplified and reliable method of manufacturing CMUT microarray modules, and further an ultrasonic sensor manufacturing process in which multiple CMUT microarrays modules may be easily provided either in a hyperboloid parabolic geometry using a three dimensional (3D) printing process, or which simulate such a configuration. Further, by changing the orientation of the individual CMUT microarray modules in the sensor array, it is possible to select preferred output beam shapes.

Accordingly, in one embodiment, the present invention provides a sensor assembly which is provided with one or more capacitive micromachined ultrasonic transducer (CMUT) microarrays modules which are provided with a number of individual transducers. In one possible final sensor construction, the CMUT microarray modules are arranged so as to simulate or orient individual transducers in a generally hyperbolic paraboloid geometry, however, other module arrangements and geometries are possible. In a most preferred use, the sensor assembly is designed for one or more of vehicular obstruction warning, automotive blind-spot monitoring, auto-drive, and/or park assist applications. A variety of other vehicular and non-vehicular applications are however, possible and will now become apparent. Such applications include without restriction, sensor applications in the marine, rail and/or aircraft industries, as well as sensor applications for use in consumer and household goods.

Preferably, the sensor assembly includes at least one CMUT microarray module which incorporates a number of individual transducer/sensors, and which are activatable individually, selectively or collectively to emit and receive reflected signals. To minimize transmission interference, the transducer/sensors are most preferably arranged in a rectangular matrix within each module, and which may be simultaneously or selectively activated. More preferably multiple microarray are provided in each sensor assembly. The microarrays are preferably mounted in at least 3×3, and preferably at least a 5×5 arrangement, and wherein each microarray module contains at least thirty-six and preferably at least two hundred individual ultrasonic transducer/sensors. In a simplified design, the sensor microarray modules are physical positioned on a three-dimensional backing which is formed to orient the microarray modules and provide the sensor array as a discretized, generally hyperbolic paraboloid shape. When provided for use in automotive applications, the hyperbolic paraboloid orientation of the modules is selected such that transducer/sensors operate to output a preferred beam field of view of between 15° and 40°, and preferably between about 20° and 25°.

More preferably, in vehicle applications, the transducer/sensor of each microarray is operable at frequencies of at least 100 kHz or more, and most preferably about 150 kHz to reflect the effects of air damping.

In one non-limiting construction, where the sensor assembly is provided for operation as vehicle blind-spot sensor, the sensor assembly is formed having a compact sensor design characterized by:

| | |
|---|---|
| Package size | PGA 68 stick lead mount |
| Update Rate | 50 to 100 ms, and preferably about 80 ms |
| Array Distribution | at least a 3 × 3, and preferably 5 × 5 Hyperbolic Paraboloid or greater |
| Beam Field of View | 15 to 170 Degrees or greater, and for automotive preferably 25 to 140 Degrees |
| Frequency Range | 50 to 200 kHz and preferably 100 to 170 kHz |
| Detection Range Goal | 3.5 to 7 meters, and preferably about 5.0 meters |

It is to be appreciated that in other embodiments, different sized sensors with different numbers of microarray modules and beamwidths, and/or CMUT microarray modules containing greater numbers of individual transducer/sensors may be provided. Depending on the application, the individual transducer/sensors may exceed thousands or tens of thousands in numbers, having regard upon the overall sensor assembly size, the intended use and component requirements.

In another embodiment, the present invention provides for sensor assembly which incorporates one or more CMUT microarray modules having individual transducers/sensors. The microarray modules are mounted to a backing in a substantially flat geometry, and which preferably has a curvature of less than ±10°, and more preferably less than ±1°. Whilst sensor assemblies may include as few as a single microarray module, more preferably, multiple CMUT microarray modules are provided, and which in a most preferred configuration are arranged in a square matrix 5×5, 9×9 or greater arrangements.

Preferably, each microarray module is provided as at least a 20×20, and preferably a 40×40 array of individual CMUT transducer/sensors. The transducer/sensors in each microarray module themselves are most preferably subdivided electrically into two or more groupings. In a simplified design, the transducers of each microarray module are oriented in a rectangular matrix and are electrically subdivided into multiple parallel rows and/or columns. Other subdivision arrangements may however, be possible, including electrically isolating individual transducer/sensors. The subdivision of the microarray transducers into parallel column or row groupings allows individual groups of transducer/sensors to be selectively coupled to a frequency generator and activated. More preferably, the sensor assembly is programmable to selectively activate or deactivate groupings of transducer/sensors within each CMUT microarray module. In a further embodiment, the microarray modules in each sensor assembly may be configured for selective activation independently from each other. In this manner, the applicant has appreciated that it is possible to effect changes in the sensor assembly beam width, shape and/or the emitted wavelength dynamically, depending on the application and/or environment. More preferably, the CMUT microarray modules are adapted to electronically output beams having a variety of different beam shapes, lengths and/or profiles.

In one preferred aspect, the individual CMUT microarray modules are formed as a generally flexible sheet which allows for free-form shaping to permit a greater range of output beam shape and/or configurations.

In one preferred mode of operation, the selective switching of power is effected to different combinations of columns of transducers in each module. The applicant has appreciated that by such switching, it is thus possible to alter the output shape of the transmitting signal emitted by the sensor assembly, as for example, to better direct the output signals from the sensor assembly to a target area of concern. In this manner, the output beam geometry may be configured to avoid false signals from other vehicles or outside sources; or to provide output beams which are scalable over a range of frequencies and/or beam widths to detect different types of obstacles, depending upon application (i.e. environment, vehicle speed, drive mode (forward versus reverse movement) and/or sensor use).

In a further preferred mode of operation, power is selectively supplied to each individual CMUT microarray module within the sensor array matrix. In this manner, individual modules may be activated to effect time-of-flight object detection and/or locations. In addition, the selective control and activation of both the individual CMUT microarray modules, as well as groupings of transducer/sensors therein advantageously allows for a wide range of three-dimensional beam shaping, to permit wider sensor applications or needs.

In one possible construction, a microprocessor control is provided. The microprocessor control actuates the switching unit and unit frequency generator. More preferably, the microprocessor control actuates the switching unit and generator to effect a computerized sequence of combinations of columns and rows of transducers within each CMUT microarray module, and change the sensor assembly output signal shape, frequency over a pre-determined sequence or range. In this manner, it is possible to further differentiate or minimize interference and false readings from other automobile sensors which could be in proximity.

Accordingly, in one aspect the present invention reside in a method of forming a capacitive micromachined transducers (CMUT) microarray comprising a plurality of transducers, said method comprising, providing a first silicon wafer having generally planar, parallel top and bottom surfaces, said first wafer having a thickness selected at upto 700 microns and preferably between about 400 and 500 microns, photoplasma etching said top surface of the first wafer to form a plurality of pockets therein, each of said pockets having a common geometric shape, each of said pockets characterized by a respective sidewall extending generally normal to said top surface and extending to a depth of upto 20 microns and preferably between about 0.2 and 5.0 microns, contiguously sealing the bottom surface of the second wafer over the top surface of the first wafer to substantially seal each pocket as a transducers air gap, applying a conductive metal layer to at least part of at least one of the bottom surface of the first wafer and the top surface of the second wafer.

In another aspect, the method of manufacturing a capacitive micromachined ultrasonic transducers (CMUT) based assembly sensor, said method comprising, providing a sensor backing platform, said backing platform including a generally square mounting surface having a width selected at between about 0.5 and 10 cm, providing a plurality CMUT transducer microarrays modules comprising a plurality of transducers, each microarray modules having a generally geometric shape and having an average width of upto 4 mm and preferably between about 1 mm and 2 mm, said microarray being formed by, providing a first silicon wafer having planar, generally parallel top and bottom surfaces, said first wafer having a thickness selected at upto 750 microns and preferably between about 400 and 500 microns, and a second wafer having a thickness of upto 50 microns, and preferably between about 0.2 and 2 microns, applying upto a 75 micron thick and preferably a 0.2 and 2 micron thick BCB adhesive layer to at least one of the first wafer top surface and the second wafer bottom surface, positioning the bottom surface of the second wafer over the surface of the first wafer to seal each said pockets as a respective transducer air gap and provide substantially contiguous seal therebetween, and applying a first conductive metal layer to at least part of at least one of the bottom surface of the first wafer and the top surface of the second wafer, applying a second conductive metal layer to either the mounting surface or the one of the bottom surface of the first wafer and the top surface of the second wafer without the first conductive metal layer, and mounting the one of the bottom surface of the first wafer and the top surface of the second wafer without the first conductive metal layer on said mounting surface.

In a further aspect, an ultrasonic sensor system for transmitting and/or receiving a sensor beam, the system including a frequency generator and a sensor assembly comprising, a backing, a plurality of capacitive micromachined ultrasonic transducer (CMUT) microarray modules, the microarray modules having a generally square configuration and being disposed in a square-grid matrix orientation on said backing, each said microarray including, a plurality of transducers having a transducer air gap and a diaphragm member, the microarray module comprising: a bottom silicon layer having a generally planar top surface and a plurality of square shaped pockets formed in said top surface, said pockets each respectively defining sides and a bottom of an associated transducer air gap and being oriented in a generally square shaped array and having a depth selected upto 50 microns and preferably at between about 0.05 and 1 microns, and a width selected at upto 300 microns and preferably between 15 and 200 microns depending on frequency range desired, and a top silicon layer overlying said planar top surface, the top silicon layer sealing each said pocket as an associated transducer diaphragm member and having a thickness selected at upto 100 microns and preferably between about 0.2 and 2 microns, and a 0.1 to 30 microns and preferably 0.2 to 2 micron thick BCB adhesive layer interposed between a bottom of said top silicon layer and said top surface of said bottom silicon layer, at least one first electrically conductive member, electrically connected to one or more of said transducer diaphragm members, at least one second electrically conductive member interposed between said backing and a bottom of said bottom silicon layer, the at least one first conductive member being electrically connectable to a ground and said frequency generator

BRIEF DESCRIPTION OF THE DRAWINGS

Reference may be had to the following detailed description, taken together with the accompanying drawings, in which.

DETAILED DESCRIPTION OF THE PREFERRED EMBODIMENTS (i) 5×5 Array

Figure 1:
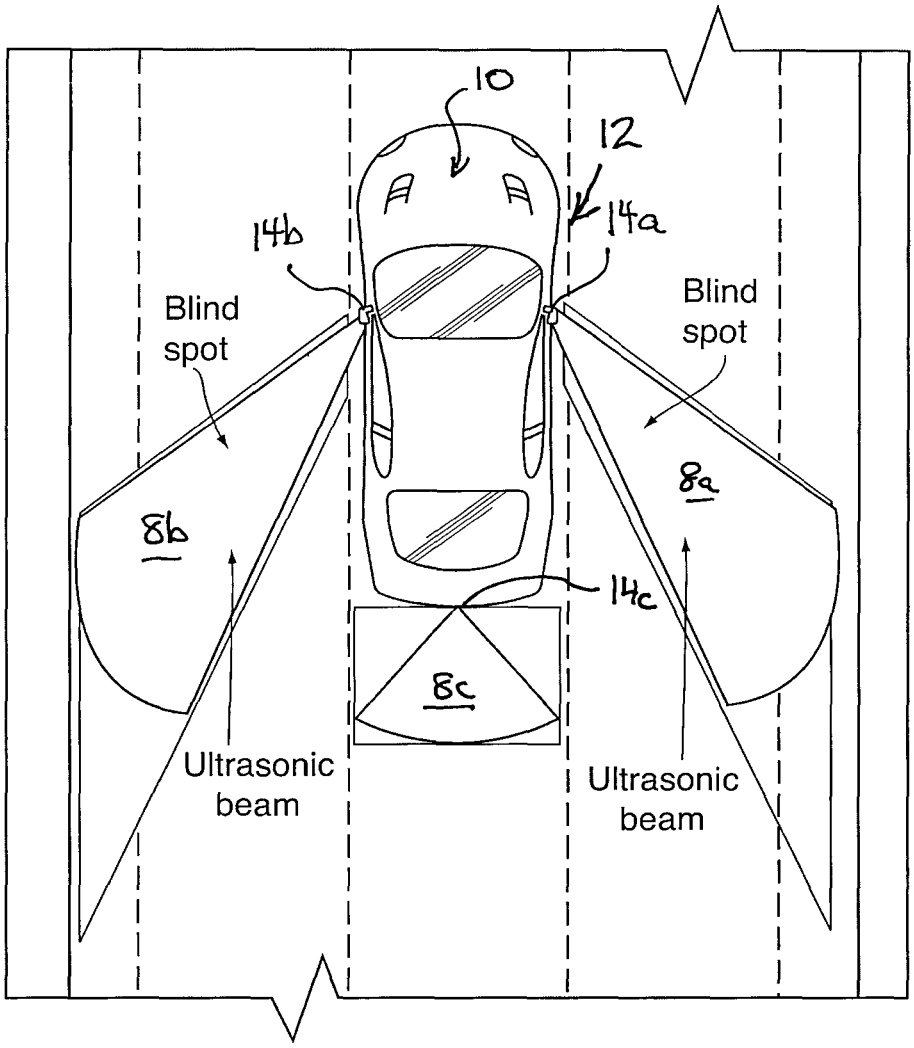
FIG. 1 shows schematically an automobile illustrating the placement of CMUT based ultrasonic sensor assemblies therein, and their desired coverage area, as part of a vehicle safety monitoring system for monitoring vehicle blind-spots.

Reference may be had to FIG. 1 which illustrates schematically a vehicle 10 having an ultrasonic based obstruction monitoring system 12 in accordance with a first embodiment. The monitoring system 12 incorporates a series of ultrasonic sensors assemblies 14*a*,14*b*,14*c* which are each operable to emit and receive ultrasonic beam signals across a respective vehicle blind-spot or area of concern 8*a*,8*b*,8*c* shown in FIG. 1, to detect adjacent vehicles and/or nearby obstructions, or encroachments in protected areas.

Figure 2:
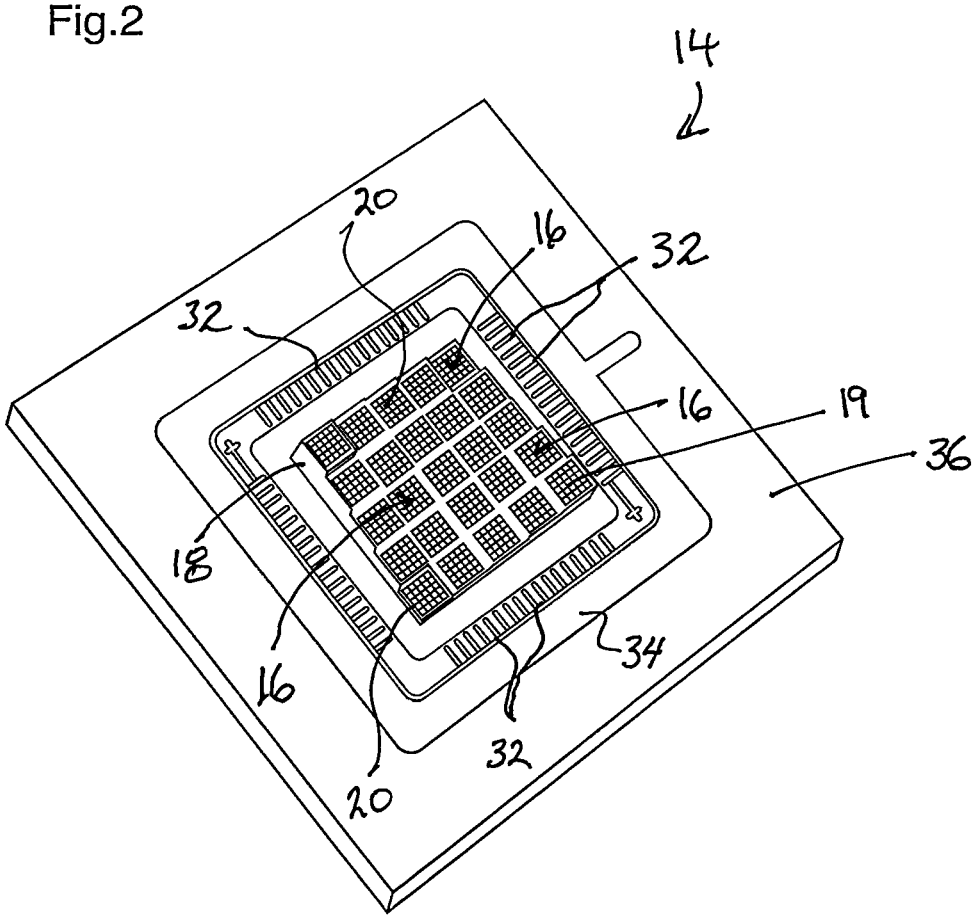
FIG. 2 illustrates an ultrasonic sensor assembly which includes a 5×5 construct of CMUT microarray modules used in the monitoring system of FIG. 1, in accordance with a first embodiment of the invention.
Figure 4A:
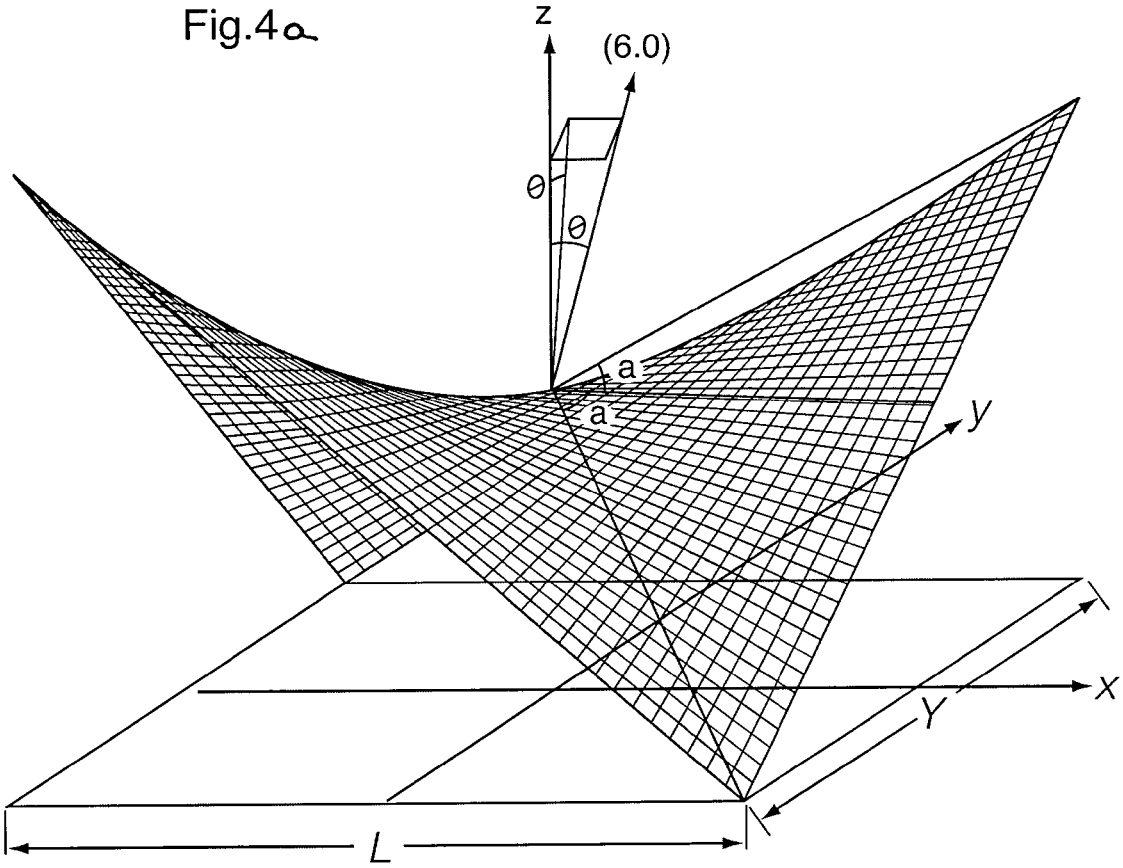
FIG. 4*a* illustrates schematically a Riemann summation technique used to mathematically discretize the geometry of a continuous hyperbolic paraboloid into the twenty-five CMUT microarray module elevations shown in FIG. 4*b*; representing an approximation of an optimum hyperbolic paraboloid surface.
Figure 4B:
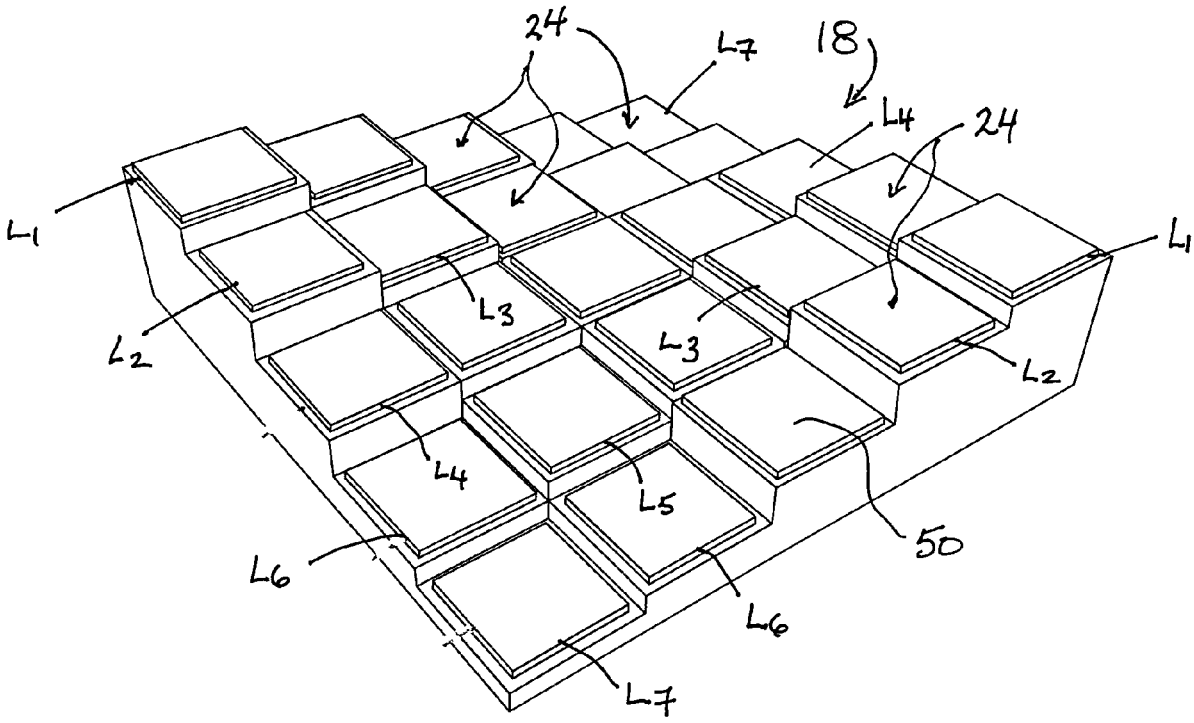

Each sensor assembly 14*a* is shown best in FIG. 2 as incorporating an array of twenty-five identical capacitive micromachined ultrasonic transducer (CMUT) microarray modules 16. As will be described, the microarray modules 16 are mounted on a three-dimensional base or backing platform 18 with the forward face or surface 19 each microarray module 16 oriented in a generally hyperbolic paraboloid geometry. FIG. 2 shows best each of the CMUT microarray modules 16 in turn, as formed from thirty-six individual CMUT transducer/sensors 20 (hereinafter transducers). The transducers 20 are positioned within a 6×6 (not shown to scale) rectangular matrix or grid arrangement within the individual microarray module 16. FIG. 4*b* shows best, the three-dimensional backing platform 18 as constructed as having a discretized hyperbolic paraboloid shape which simulate the continuous curving hyperbolic paraboloid curvature shown in FIG. 4*a*. In simplified form of manufacture, the backing platform 18 is formed as a three-dimensional plastic or silicon backing which presents twenty-five separate discrete planar square mounting surfaces 24 (FIG. 4*b*). Each mounting surface 24 has a co-planar construction and a complimentary size selected to receive and support an associated CMUT microarray module 16 thereon. In this manner, the CMUT microarray module 16 are themselves mounted on the three-dimensional backing platform 18, with the raised geometry of the mounting surfaces 24 orienting the arrays of microarrays 16 in the desired generally discretized hyperbolic paraboloid geometry. The backing platform 18 is provided with an electrically conductive gold or copper top face coating layer 50 which functions as a common ground layer for each module transducer 20. The backing layer 18 in turn is electrically gold bonded to suitable pin connectors 32 (FIG. 2) used to mount the pin base 34 as the sensor chip 36.

The applicant has appreciated that by varying the curvature simulated by the relative positioning of the mounting surfaces 24 in different hyperbolic paraboloid configurations, it is possible to vary the output beam geometry of the sensor chip 36, to tailor it to a desired application. By way of example, where the sensor assembly 14 is used as backup sensor 14*a*, the backing platform 18 may be provided with a flatter hyperbolic paraboloid curvature to a comparatively wider, shorter beam signals (see for example FIG. 13). In contrast, sensor assemblies 14*a*,14*b* may be provided with a backing platform 18 having a relatively higher degree of curvature to output narrower layer beam signals.

In a most simplified construction, the 6×6 array of individual transducers 20 within each CMUT microarray module 16 present a generally planar forward surface 19 (FIG. 2) which functions as a signal emitter/receptor surface for the generated ultrasonic signals. In use, the individual transducers 20 are electronically activated to emit and then receive an ultrasonic beam signals which are reflected by nearby vehicles and/or obstructions. In this manner, depending on the timing between signal emission, reflection and reception and/or the intensity of the reflected ultrasonic signals which are detected by each microarray module 16, the monitoring system 12 may be used to provide either an obstruction warning, or in case of auto-drive applications, control the vehicle operation speed and/or direction.

In the construction of each ultrasonic sensors assembly 14, each CMUT microarray module 16 used in the monitoring system 12 preferably is formed having a footprint area of about 1 to 5 $mm^2$, and a height of about 0.5 to 2 mm. Each sensor chip 36 thus houses 900 individual transducers 20 in microarray groupings of thirty-six at seven discrete elevation levels, $L_{1-7}$, in the 5×5 matrix distribution shown in FIG. 2.

Figure 5:
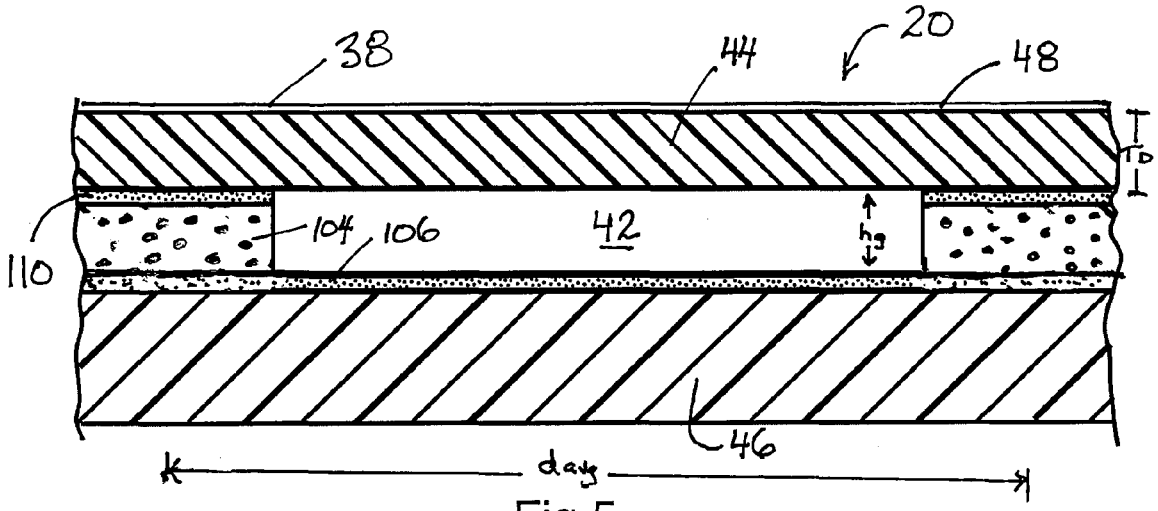
FIG. 5 provides an enlarged cross-sectional view of an individual CMUT transducer used in the ultrasonic sensor CMUT microarray module shown of FIG. 2, in accordance with a first manufacture.

FIG. 5 shows best an enlarged cross-sectional view of the transducers 20 found in each CMUT microarray module 16 in accordance with a first construction. In particular, a transducer 20 is provided with a generally square-shaped central air cavity or air gap 42. The transducers 20 each have an average square lateral width dimension $d_{avg}$ selected at between about 20 and 50 μm, and preferably about 30 μm, with an interior air gap 42 extending between about 60 and 80% of the lateral width of the transducer 20. Preferably the air gap 42 is defined at its lower extent by a silicon bottom wafer or layer 46, and which depending on manufacture may or may not be provided with a coating. The air gap 42 has a height $h_g$ selected at between about 800 to 1000 nm, and more preferably about 900 nm. The air gap 42 is overlain by 0.5 to 1 μm, and preferably about a 0.8 μm thick silicon diaphragm membrane 44. A 0.1 to 0.2 μm thick gold conductive layer 48 is coated over the diaphragm membrane 44 of the transducers in each microarray module 16. The conductive layer thickness is selected so as not to interfere with diaphragm movement. In addition, the bottom conductive coating 50 is provided either directly along a rear surface of the silicon bottom layer 46 of each transducer 20, or more preferably is pre-applied over each mounting surface 24 of the backing platform 18. In this manner, by electrically coupling the top conductive layer 48 of each microarray module 16 and the conductive coating layer 50 on the backing platform 18 to a frequency generator (shown as 70 in FIG. 7), the diaphragm membranes 44 of the transducers 20 may be activated to emit and/or receive and sense generated ultrasonic signals.

Figure 3:
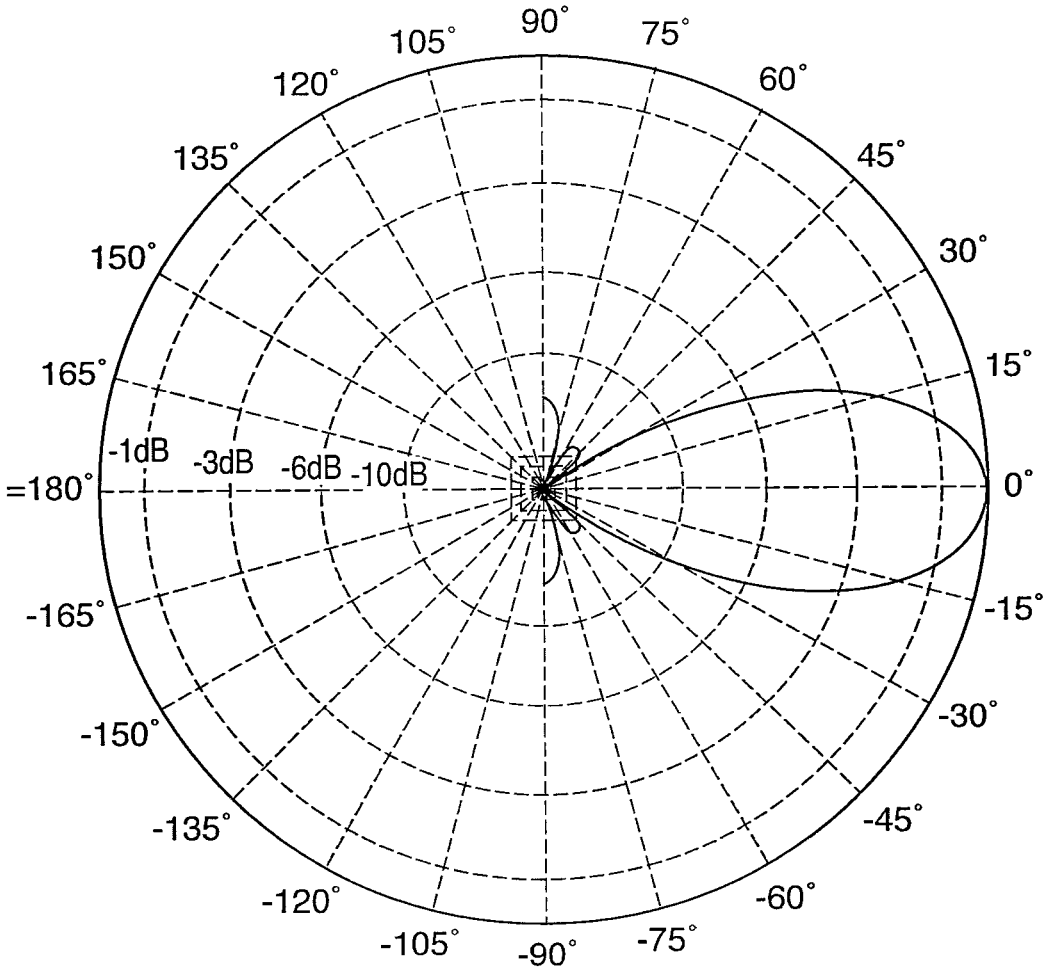
FIG. 3 illustrates a polar plot of the beam output geometry of the 5×5 construct of CMUT microarray module shown in FIG. 2.

As shown best in FIG. 3, the individual CMUT microarray modules 16 are concurrently operable to transmit and receive a beam signal at a frequency at a range of between about 113-167 kHz, and most preferably in rain or fog environments at least about 150 kHz±13, and a beamwidth of 20±5° with a maximum sidelobe intensity of −6 dB. The sensor microarray module 16 provides frequency independent broadband beam forming, without any microelectronic signal processing.

In one possible method of manufacture, the transducers 20 may be fabricated using a SOI technology, with the three-dimensional backing platform 18 formed of silicon, and are assembled and packaged in a programmable gain amplifier PGA-68 package. The present invention also provides for a more simplified method of manufacturing the three-dimensional hyperbolic paraboloid chip 36 construct, and more preferably wherein the hyperbolic paraboloid chip 36 functions with the hyperbolic paraboloid geometry capacitive micromachined ultrasonic transducer. In this regard, the three-dimensional chip 36 may be assembled using a backing platform 18 formed from plastic, and more preferably acrylonitrile butadiene styrene (ABS), that is formed to shape by means of a 3D printing process. In an alternate production method the 3D chip backing platform 18 may be formed by injection molding through micro-molding injection molding processes.

In assembly, the backing platform 18 having the desired discretized formed 3D surface (and preferably formed of ABS plastic) is coated with a suitable conductive metal deposited coating layer 50 using sputtering, electroplating, electroless plating/coating, plasma coating and/or other metalizing processes. The mode of metal deposition is selected to enable placement of a continuous controlled layer of conductive metal over the top face of the ABS plastic backing platform 18, as formed. The conductive metal coating layer 50 is selected to provide a ground conductor for one side of the transducers 20 within each microarray module 16. Preferred metals for deposition include copper, gold, silver, aluminum or other highly electrically conductive metals. Each CMUT microarray module 16 is thereafter positioned and adhered with a conductive adhesive directly on to an associated mounting surface 24 in electrical contact with the conductive metal coating layer 50 of the backing platform 18, and the backing platform 18 is mounted to the pin base 34 using pin connectors 32.

While in a simplified construction, the forward surface 22 of the transducers sensors 20 in each microarray module 16 provide a generally planar surface, the invention is not limited. In an alternate construction, the forward surface 22 of each microarray module 16 may be provided with or adapted for curvature. In such an arrangement, the transducers 20 within each of the CMUT microarray module 16 are themselves assembled directly on a flexible and compliable bottom layer 46 or backing substrate. Such a backing substrate is selected from a material and having a thickness to allow microarray module 16 to be flexed or bent to better conform to an actual 3D hyperbolic paraboloid surface, as a continuous free-form surface, as opposed to stepped surfaces that approximate such a free-form surface. Preferred flexible backings for the microarray modules 16 would include silicon wafer backings having thicknesses of less than about 5 μm, and preferably less than 1 μm, as well as backing layers made from Cylothane or bisbenzocyclobutene (BCB). Such a free-form surface advantageously allows the flexible backing of each CMUT microarray module 16 to be placed directly onto a free-form molded backing platform 18, providing the sensor chip 36 with a more accurate approximation of an actual hyperbolic paraboloid surface topography.

The inventor has recognized that when used as part of a vehicle monitoring system 12, the operating range of the CMUT microarray modules 16 may prove to have increased importance. Although not essential, preferably, to design for a specific range, distance damping and absorption attenuation of the air at the specific operating point is determined. Damping of sound is generally known to be calculated with the theory of the air damping (air resistance) as below:

$$P_{SPLdamping}=-20\log_{10}(R_1/R_2)$$

Where $R_1$ is 30 cms for SPL standardization purposes, and $R_2$ is the maximum distance to reach. For 5 m of distance, the ultrasound should travel 10 m. Solving the equation yields −30 dB of damping in 10 m distance. Also, the absorption of the air due to humidity is calculated as follows:

$$\alpha(f)=0.022f-0.6\ \text{dB/ft}$$

Where α is the air absorption due to frequency f. The humidity is taken as 100% for the worst case scenario. Over the range of 10 m after conversion from ft, this absorption value is calculated to be −53 dB for 150 kHz.

It is therefore to be recognized when the total values there may exist significant damping of −83 dB. In contrast, the applicant has recognized that if the transducers 20 were operated in 60 kHz, total damping and absorption would be −51 dB, which will allow a much powerful received ultrasound signal.

In the construction of FIG. 2, after obtaining the total damping and absorption values, the individual transducers 20 are designed accordingly. In particular, since the total damping values add up to −83 dB, the CMUT transducers 20 are most preferably designed to have very high output pressure, and most optionally 100 dB SPL or more. It has been recognized that preferably the diaphragm membrane 44 (FIG. 5) of the CMUT transducers 20 is chosen with a thickness ($T_D$) (FIG. 5) less than 20 μm, preferably less than 5 μm, and most preferably about 1 μm. The selected membrane dimensions allow the diaphragm membrane 44 to have a large distance for vibration, and a lower DC operating voltage.

Also following Mason's theory, (see *Design of a MEMS Discretized Hyperbolic Paraboloid Geometry Ultrasonic Sensor Microarray*, IEEE Transactions On Ultrasonics, Ferroelectrics, and Frequency Control, Vol. 55, No. 6, June 2008, the disclosure of which is incorporated hereby reference). Each CMUT transducer 20 is designed to operate over a frequency range of 110 to 163 kHz, and with the sensor assembly 14 having twenty-five microarray modules 16 in accordance with specifications shown in Table 1. A most preferred operating frequency is selected at about 150 kHz±13, with the 5×5 array of CMUT microarray modules 16 designed with a 40°−3 dB bandwidth and side lobes lower than −10 Db, as shown in FIG. 3. In this regard sound pressure can be found following the equation:

$$P_a=Re(Z_m)\omega A_a$$

Where $A_a$ is the amplitude of the acoustic wave, which is equal to the displacement of the CMUT membrane, ω is the angular frequency of the diaphragm and $Z_m$ is acoustic radiative impedance of the membrane obtained from Mason's method reference above.

TABLE 1

CMUT Sensor Array specifications

| Parameter | Value |
|---|---|
| Module Array | 5 × 5 |
| Array −3 dB beamwidth (°) | 40° |
| Sensor sidelength (mm) | 15.75 |
| CMUT microarray module sidelength (mm) | 1.6-1.8 |
| CMUT transducer diaphragm material | Low resistivity polysilicon |
| CMUT transducer sidelength (mm) | 0.25-0.3 |
| CMUT transducer diaphragm thickness (μm) | 0.5-1.0 |
| CMUT transducer resonant frequency (kHz) | 150 (±13) |
| CMUT transducer air-gap (μm) | 2.5-4 |
| Array pressure output (dB SPL) | 102.5 |
| CMUT bias voltage ($V_{DC}$) | 40 |
| CMUT pull-in voltage ($V_{DC}$) | 51 |

TABLE 1-continued

| CMUT Sensor Array specifications | |
|---|---|
| Parameter | Value |
| CMUT receive sensitivity (mV/Pa) | 60 |
| Received signal at 10 m (mV) | 2 |

Figure 6:
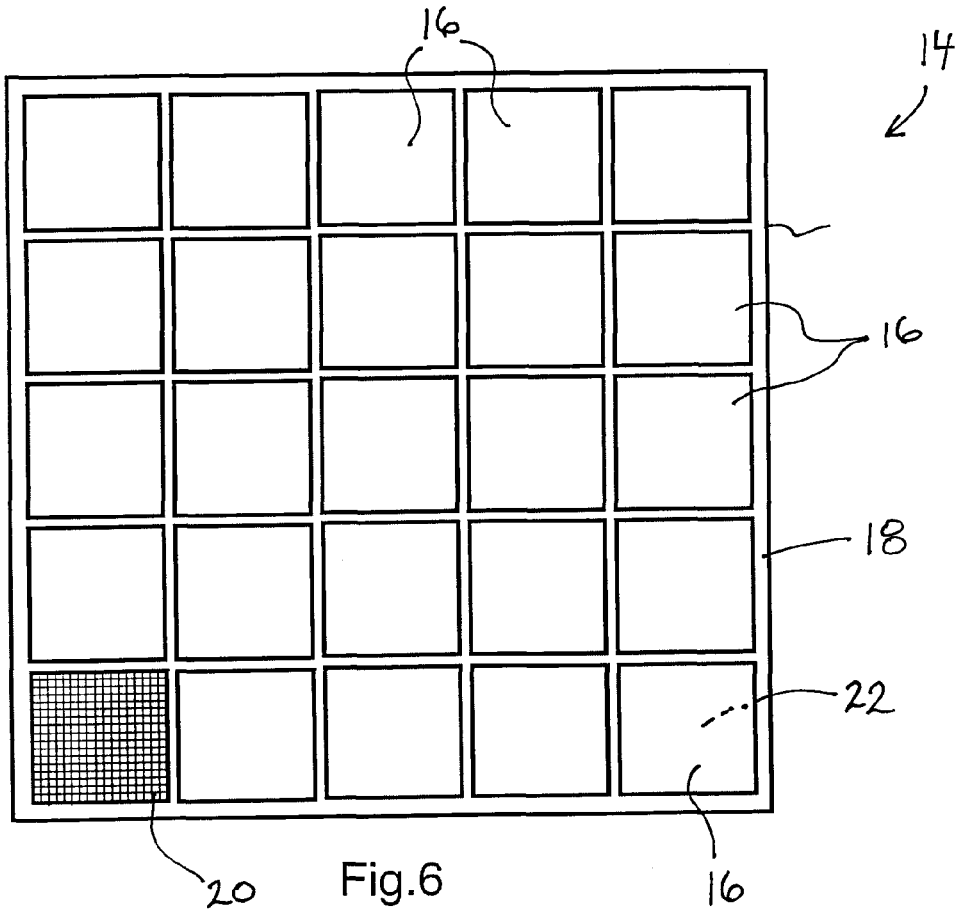
FIG. 6 illustrates schematically an ultrasonic sensor assembly having a 5×5 array construct of twenty-five CMUT microarray modules in accordance a second embodiment of the invention.

FIG. 6 illustrates an ultrasonic sensor assembly 14 in accordance with another embodiment of the invention, in which like reference numerals are used to identify like components. In FIG. 6, the ultrasonic sensor assembly 14 is provided with a 5×5 square array of twenty-five CMUT microarray modules 16. Each of the CMUT microarray modules 16 are in turn formed as a square 40×40 matrix of 1600 individual transducers 20 (not shown to scale).

In one possible embodiment the 40×40 CMUT microarray modules 16 are secured to an ABS backing platform 18 which has a geometry similar to that shown in FIG. 4, and which has been discretized in 1.7×1.7 mm flat mounting surfaces 22. In such a construction, the backing platform 18 is formed as an approximated hyperbolic paraboloid surface in the manner described above.

In a more preferred alternate design, however, the backing platform 18 is made as a substantially flat ABS construct, having a hyperbolic paraboloid curvature less than about ±10°, preferably less than about ±1°, and more preferably less than ±0.5°, wherein one or more of the transducers 20 within each CMUT microarray module 16 is operable to more closely simulate their mounting in a hyperbolic paraboloid geometry. The microarrays modules 16 are electrically bonded on their rearward side to the conductive metal coating layer 50 which has been bonded as a metal layer deposited on the ABS backing platform 18 in the manner as described above. A top metal coating 38 is provided as the second other power conductor for the CMUT transducers 20, allowing each microarray 16 to operate in both send and receive mode.

Each 40×40 microarray module 16 has a square construction of between about 1 and 2 mm in sidewidth and contains approximately 1600 transducers 20. As shown best in FIGS. 7 and 10, the transducers 20 are arranged in a square matrix orientation of parallel rows and columns within each microarray module 16. The transducers 20 of the module 16 of FIG. 6 are shown best in FIG. 10 have an average lateral width dimension $d_{avg}$ selected at between about 0.02 to 0.05 mm and more preferably about 0.03 mm. Each transducer 20 defines a respective rectangular air gap 42 (FIG. 10) which has a height $h_g$ of up to 3 nm and preferably between about 2.5 to 4 μm, and width in lateral direction selected at between about 0.01 and 0.03 mm.

Figure 7:
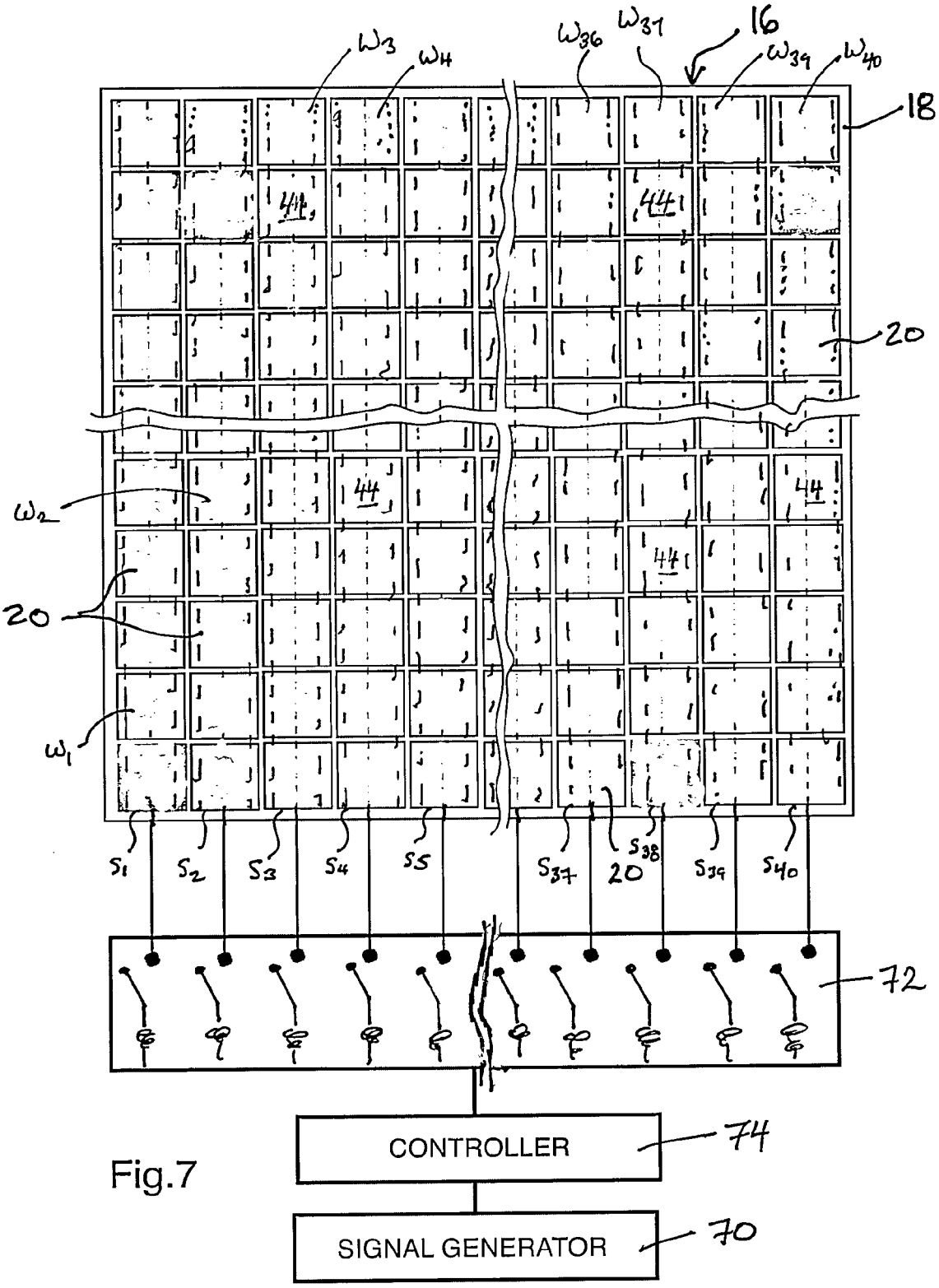
FIG. 7 illustrates schematically an enlarged view of an individual CMUT microarray module used in the ultrasonic sensor array of FIG. 6.
Figure 10:
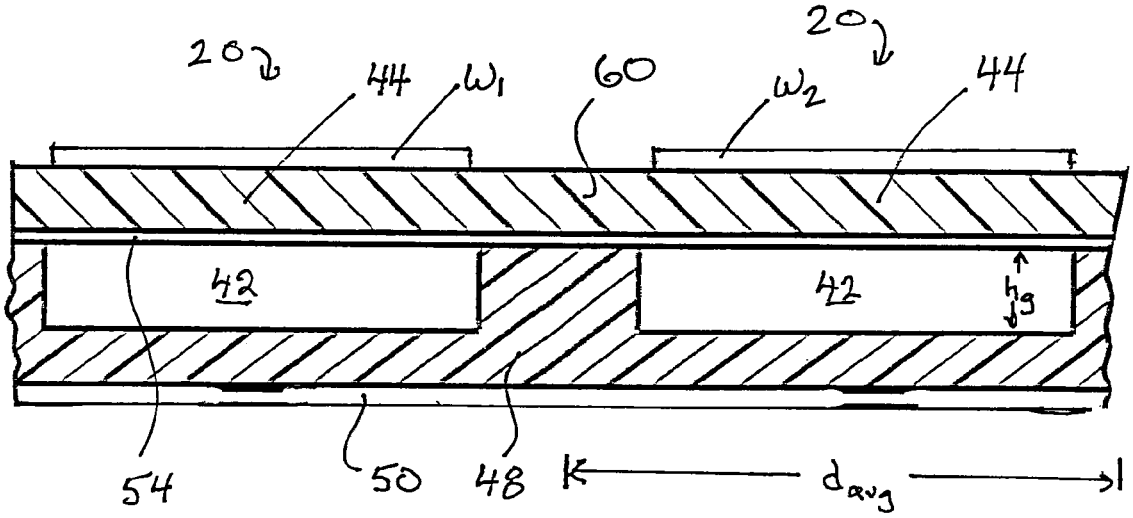
FIG. 10 illustrates schematically an enlarged partial cross-sectional view of a transducer/sensor used in the CMUT microarray module shown in FIG. 7, in accordance with a further method of manufacture.

FIG. 10 shows best the transducers 20 as having a simplified construction including a silicon bottom or backing layer 48, and which is secured by way of a 0.5 to 20 μm thick layer 54 of Cyclotene™ or other suitable bisbenzocyclobutene (BCB) resin layer to an upper top silicon wafer 60. As will be described, the top wafer 60 defines the diaphragm membrane 44, and has a thickness selected at between about 0.5 nm and 1.0 nm. As shown in FIGS. 7 and 10, a conductive gold wire strip bonding ($W_1$,$W_2$) is further provided across the diaphragm membranes 44, and which is electrically connected to the frequency generator 70.

Each 40×40 microarray module 16 is positioned as a discrete unit on the substantially flat substrate or backing layer 18. Within each individual 40×40 microarray module 16, the transducers 20 are grouped into parallel strips or columns $S_1$, $S_2$, . . . $S_{40}$. The transducers 20 in each column $S_1$, $S_2$, . . . $S_{40}$, are electrically connected to each other by an overlaying associated conductive gold wire bonding $W_1$, $W_2$, $W_3$ . . . $W_{40}$.

As shown in FIG. 7, the gold wire bonding $W_1$, $W_2$, $W_3$ . . . $W_{40}$ are in turn selectively electrically coupled to the conventional frequency generator 70 by way of a switching circuit 72 and microprocessor controller 74. The frequency generator 70 is operable to selectively provide electrical signals or pulses at pre-selected frequencies. The applicant has appreciated that the activation of each individual or selected columns $S_1$, $S_2$ . . . $S_{40}$ of transducers 20 within each microarray 16 may change in the output wavelength of the sensor assembly 14 by a factor of approximately 0.1λ. By activating the switching circuit 72 to selectively switch power on and off to different combinations of columns $S_1$, $S_2$, . . . $S_{40}$ of transducers 20 in each microarray module 16, it is possible to alter the signal shape of the transmitting signal wavelength output from the sensor assembly 14.

The generation of each electric pulse by the frequency generator 70 may thus be used to effect the physical displacement of the diaphragm membranes 44 of each transducer 20 within one or more selected columns $S_1$, $S_2$, . . . $S_{40}$ electrically connected thereto by the switching assembly 72 to produce a desired output ultrasonic wave frequency and/or profile Having regard to the operation mode of the sensor array 14. The applicant has appreciated that in a most preferred configuration, signals are output from the sensor array 14 at wavelengths of between 110 kHz to 163 kHz, and preferably about 150 kHz. By the selective activation and deactivation of individual columns $S_1$, $S_2$ . . . $S_{40}$ of transducers 20 in each microarray module 16, it is possible to control by way of a microprocessor controller 74, the output beamwidth and/or frequency, depending upon the particular application requirement for the sensor system 12.

Figure 8A:
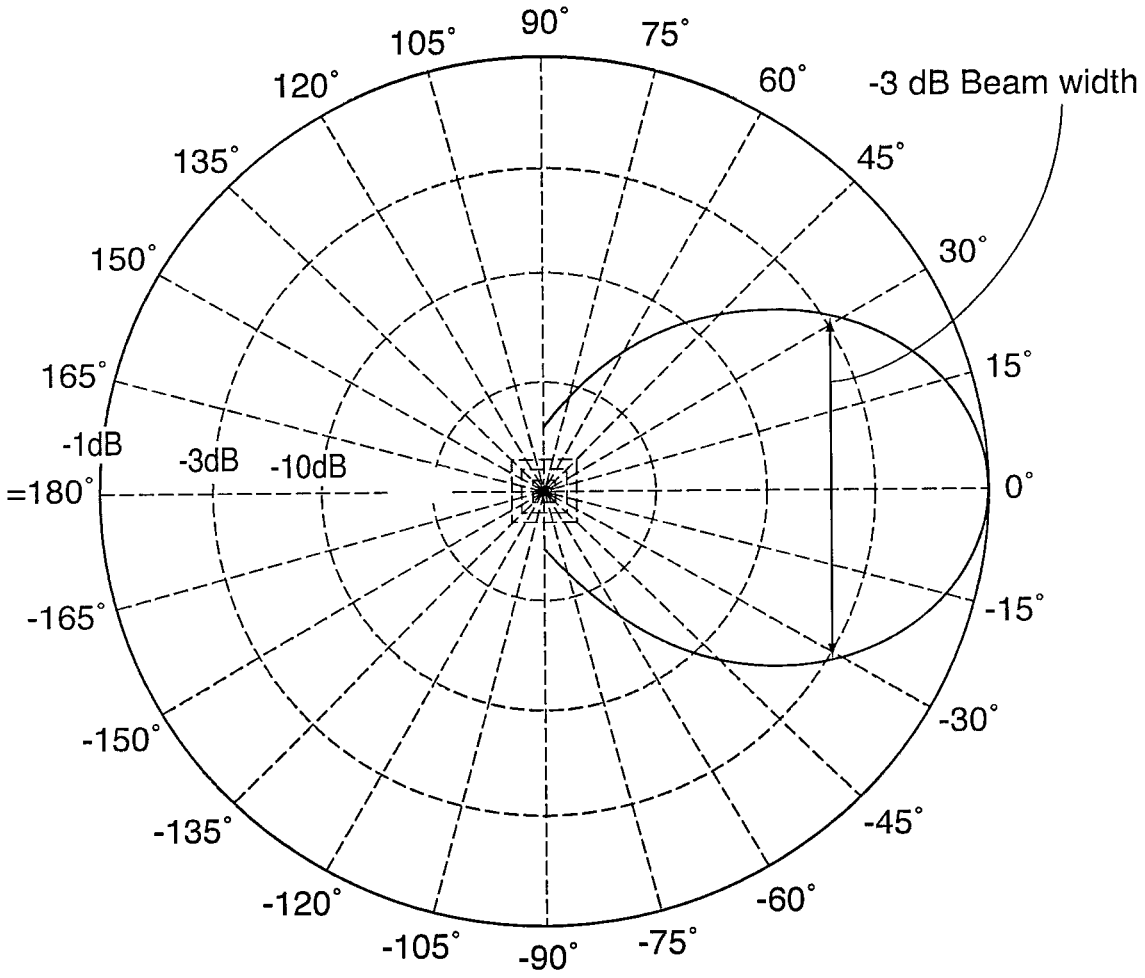
FIGS. 8*a*, 8*b*, and 8*c* illustrate polar plots of electronically selected beam output geometries of output signals from the ultrasonic sensor assembly shown in FIG. 6.
Figure 8B:
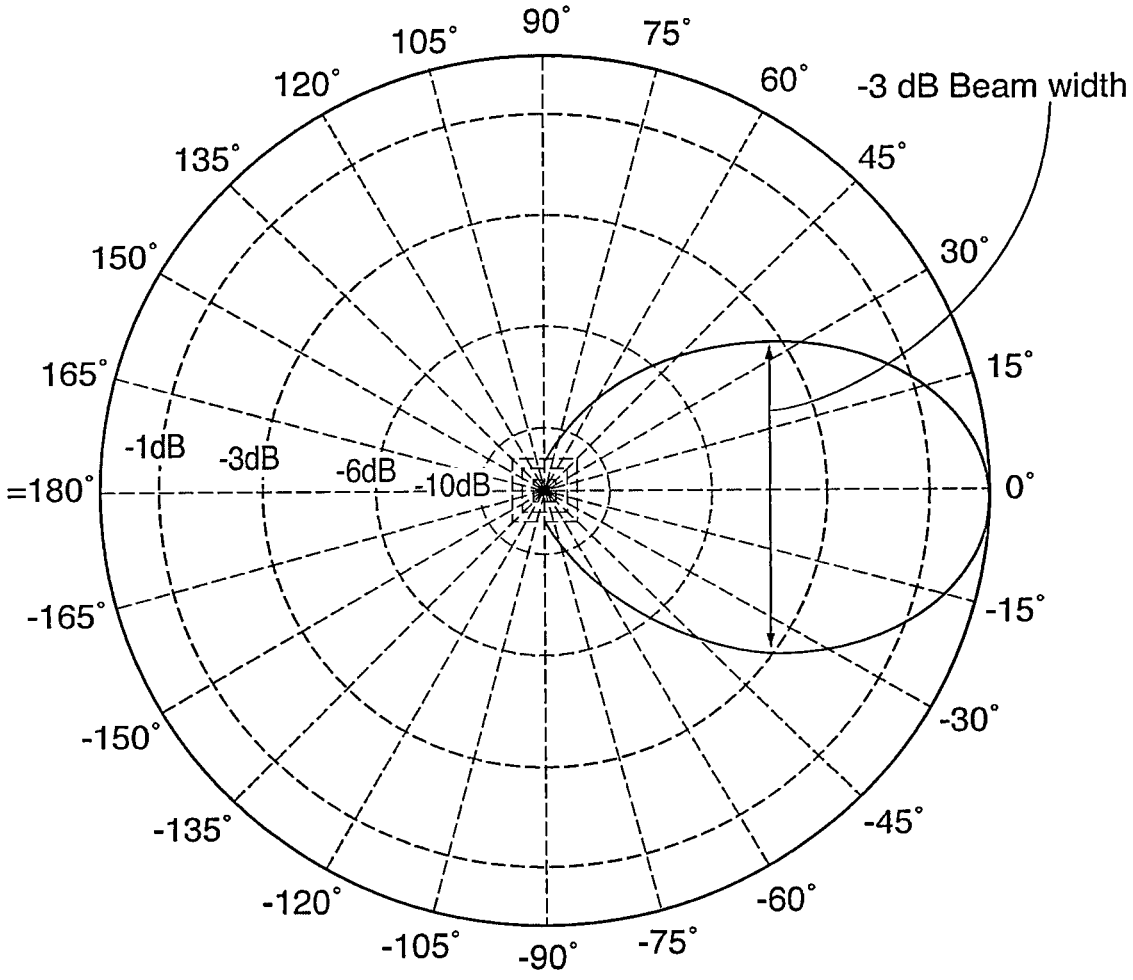
Figure 8C:
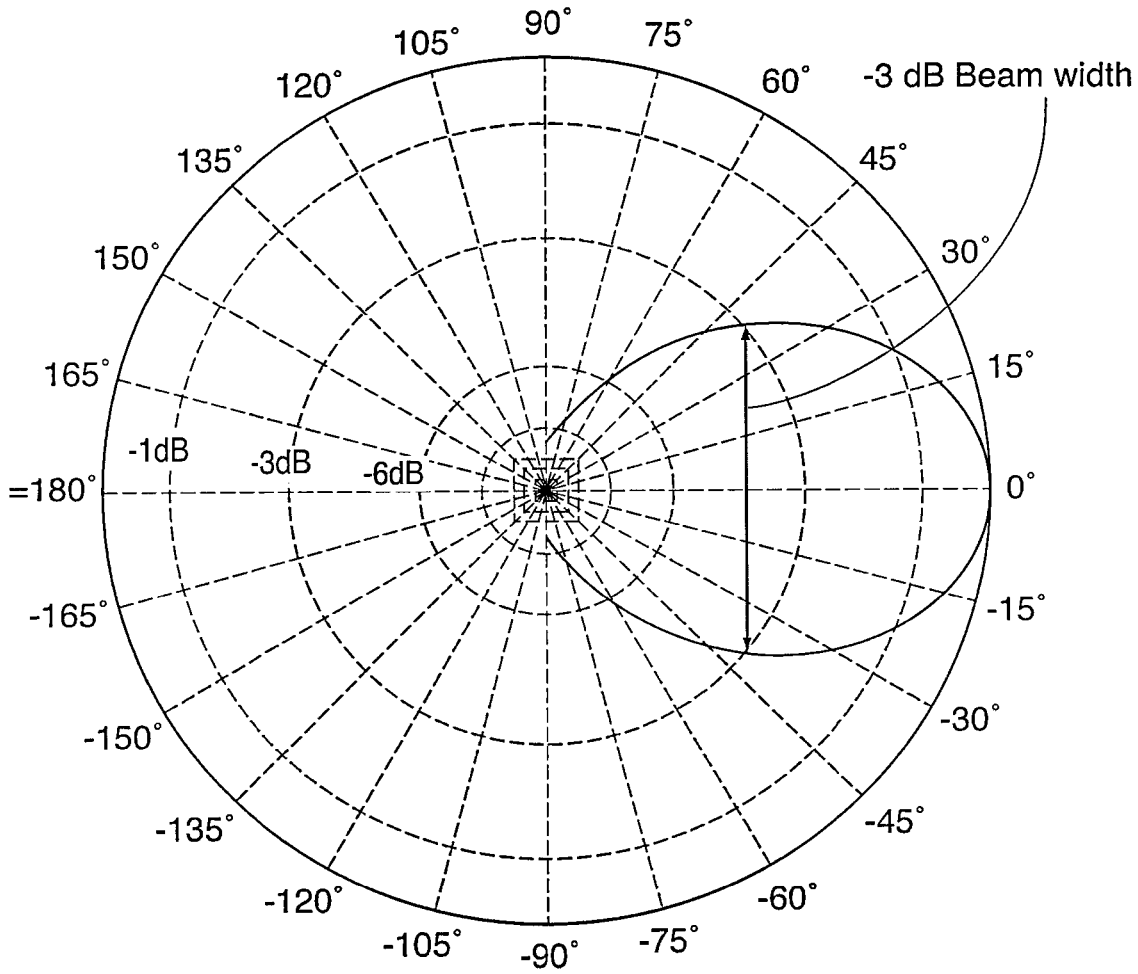

In particular, FIGS. 8*a* to 8*c* show that depending upon the application requirements or mode of vehicle operation, it is possible to selective activate individual transducers 20 to output a wider beam, where for example, the sensor assembly 14 is used to provide warning signals in low speed back-up assist applications. In addition, different transducer 20 combinations in the same sensor assembly 14 may be activated to provide a narrower longer beamwidth, where for example, the vehicle is being driven at speed, and the sensor assembly 14 is operating to provide a blind-spot warning, as for example, during vehicle passing or lane change. In a most preferred mode of operation, the controller 74 is used to control the switching circuit 72 to activate the same sequences of columns $S_1$, $S_2$ . . . $S_{40}$ of transducers 20 within each of the CMUT microarray module 16 concurrently during operation of the sensor assembly 14. This advantageously may minimize any adverse nodal effects and/or signal interference between signals output by the individual CMUT microarray module 16 within the sensor.

In another mode of operation, the microprocessor controller 74 may be used to activate the switching circuit 72 to selective actuate the columns $S_1$, $S_2$ . . . $S_{40}$ of transducers 20 in predetermined sequences to output signals of changing frequency. In yet another mode, the controller 74 may be used to activate the switching assembly 72 to initiate one or more individual columns $S_1$,$S_n$ of specific transducers 20 within only selected microarray modules 16 within the 5×5 array. In this regard, the signals output by the sensor assembly 14 may be coded or sequenced across a frequency range to more readily allow for the differentiation of third party sensor signals, minimizing the possibility of cross-sensor interference or false warning.

It is envisioned that the sensor assembly 14 shown in FIG. 6 thus advantageously allows for programmable beamwidths to be selected at 20 and 140° or more, by using the controller 74 and switching circuit 72 to change the sensor output wavelength dynamic.

While FIG. 6 illustrates the sensor assembly 14 as including twenty-five CMUT microarray modules 16 arranged in a 5×5 matrix configuration, the invention is not so limited. It is to be appreciated that in alternate constructions, greater or smaller number of microarray modules 16 having fewer or more transducers 20 may be provided. Such configurations would include without limitation rectangular strip, generally circular and/or to the geometric or amorphous groupings of modules; as well as groupings of forty-nine or fifty-four CMUT microarray modules 16 mounted in 7×7, 9×9 or other square arrangements.

While FIG. 7 illustrates the transducers 20 within each CMUT microarray module 16 as being divided into forty separate columns $S_1, S_2 \ldots S_{40}$, it is to be appreciated that in alternate configuration the transducers 20 in each microarray 16 may be further grouped and/or alternately individually controlled. In one non-limiting example, the transducers 20 may be further grouped and electrically connected by row, with individual columns and/or rows within each CMUT microarray module 16 being selectively actuatable by the controller 74, switching circuit 72 and frequency generator 70.

The sensor design provides for a 40×40 CMUT microarray modules 16 having a square configuration, with the sensor chip 36 having a dimension of about 7 to 10 mm per side, and which is machined flat or substantially for marginally hyperbolic with the ±0.5° curvature. Preliminary testing indicates that the ultrasonic sensor assembly 14 is operable to transmit and receive signals through solid plastic bumper materials having thicknesses of upto several millimeters, and without the requirement to have currently existing "buttons" or collectors. As such, the sensor assembly 14 may advantageously be "installed behind the bumper" in automotive applications, using smooth surfaced bumper panels, creating a more aesthetically pleasing appearance.

Figure 9:
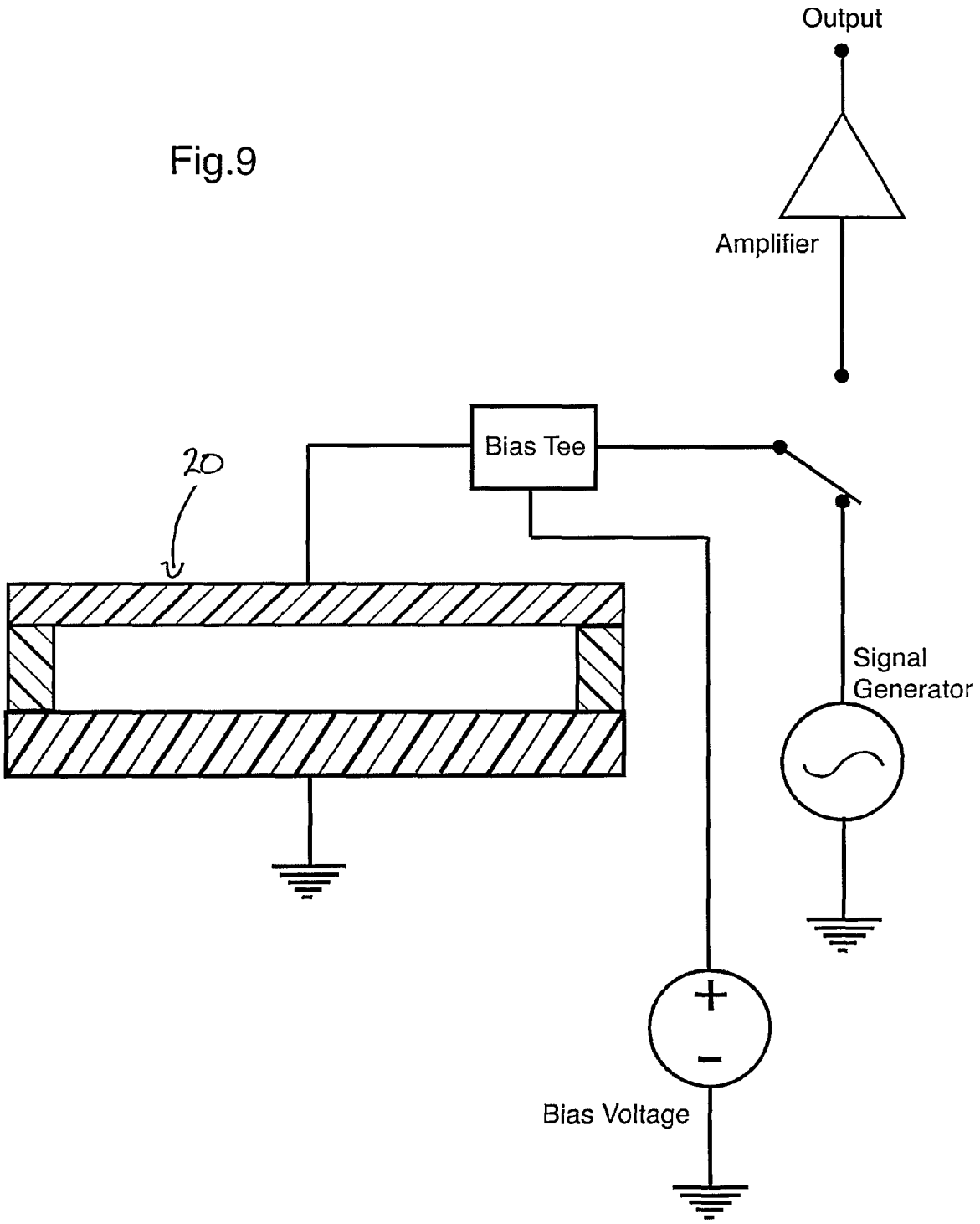
FIG. 9 illustrates schematically the operation of the individual transducer/sensors of the CMUT microarray modules shown in FIG. 7.

In operation, in receive mode (FIG. 9) all of the CMUT transducers 20 preferably are activated to receive return beam signals at the same time. The beam strength of the signals received, and/or the response time is thus used to determine obstruction proximity. In receive mode, the entirety of each CMUT microarray module 16 receives signals by impact which results in defection of the transducer diaphragm membranes 44 to generate receptor signals. The intensity and time of flight of the return signals detected by the degree of defection of each diaphragm membrane 44 provides an indication as to the proximity of an adjacent obstruction and/or vehicle.

Transducer Manufacture

In one most simplified mode of manufacture, the fabrication process of the transducers 20 includes bonding together two wafers to simultaneously form multiple CMUT microarray modules 16 having 1600 CMUT transducers 20 shown in FIG. 10, and which are cut from a formed wafer sheet. FIG. 10 depicts a cross-sectional view of adjacent CMUT transducers 20 which measure approximately 30×30 micrometers. In a most preferred construction, completed CMUT microarray 16 will include 40×40 square matrix of 1600 CMUT transducers 20, and a have a dimensional width of between about 1.7 mm by 1.7 mm. As such, each 9×9 CMUT chip 36 preferably will be provided with roughly 57600 individual CMUT transducers 20.

Figure 11:
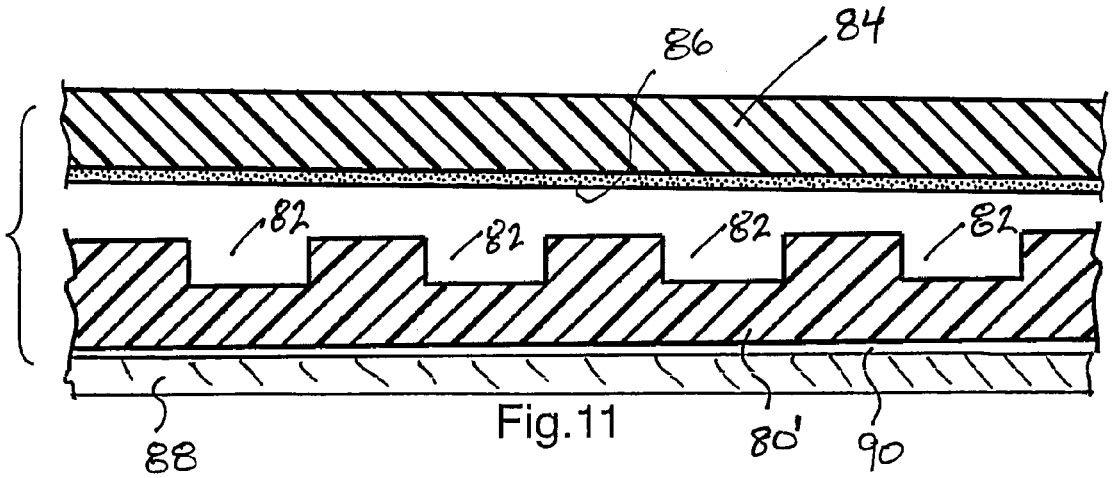
FIG. 11 illustrates schematically the manufacture of top and bottom silicon wafers used in the manufacture of the CMUT microarray module shown in FIG. 10 using BCB bonding.
Figure 12:
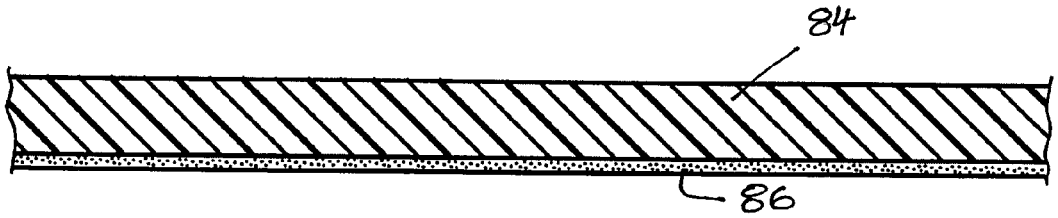
FIG. 12 illustrates schematically the manufacture of a top wafer layer of FIG. 11, with a BCB bonding coating layer applied thereto.
Figure 13:
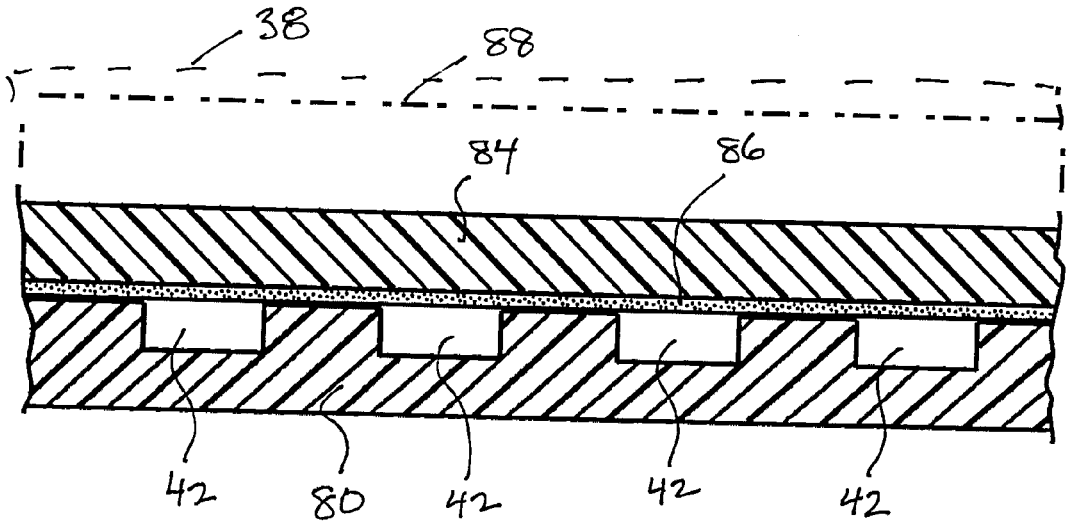
FIG. 13 illustrates schematically the assembly of the top and bottom wafer layers shown in FIG. 11 prior to diaphragm thinning and the photoprinting of gold conductive layers thereon.

The manufacture of each 40×40 microarray module 16 is performed largely as a two-component manufacturing process as described with reference to FIGS. 11 to 13. In manufacture, the microarray module 16 is prepared by joining a first silicon wafer sheet 80 (FIG. 13) having individual transducer air-gap recesses pockets 82 formed therein to a second covering silicon wafer 84 using a BCB resin layer 86.

In the formation of the first wafer 84, a removable silicon holder piece 88 (not shown to scale) is provided. A dissolvable adhesive 90 is next coated on the silicon holder piece 88, and a 0.5 to 2 mm thick silicon wafer blank 80' is then secured and mounted to the holder piece 88. The silicon wafer blank 80' is next masked using a photoresist coating. The coating is selected to pattern the wafer 80' with the desired air pocket 82 configuration of the desired transducer air gap arrays. After exposure and activation, the inactive coating is removed to expose the selected air pocket configuration and wafer blank 80' for photo-plasma etching. The wafer blank 80' is photo-plasma etched to a selected time period necessary to form the individual pocket recesses 82 (FIG. 11). The pockets 82 are formed with a size and desired spacing to function as the air-gap 42 of each transducer 20. The pockets 82 are preferably formed with a width of about 0.03 mm in each later direction, and to a depth of about 2.5 to 4 μm. Although not essential, the pockets 82 are preferably manufactured having a square shape to maximize their number of placement space on the wafer blank 80'. Other embodiments could however, include circular-shaped pockets or recesses 82 resulting in a larger chip, or those of a polygonal or hexagonal shape. The pockets 82 are preferably formed in a rectangular matrix orientation to allow simplified transducer switching, however other configurations are possible.

At the bottom of each pocket 82, the wafer blank 80' preferably has a thickness selected at about 0.5 mm. Optionally, in manufacture, the wafer blank 80' may be inverted with each pocket bottom operating as the displaceable diaphragm membrane 44 of each CMUT transducer 20. Preferably, however, the silicon wafer 84 is provided as a top covering layer with a desired thickness selected to function as the displaceable diaphragm membrane 44.

The top wafer 84 is separately formed. In a simplified construction, the top wafer 84 is machined from a preform by grinding to a desired thickness, and most preferably a thickness selected at between about 0.2 to 2 μm. Following formation, the silicon wafer 84 is secured to the bottom wafer 80 in position over top of the open pockets 82 using upto a 10 μm, and preferably 0.05 to 1 μm thick adhesive layer 86 of BCB (Cyclotene) resin as a glue. Cyclotene provides various advantages. In particular, the use of the BCB layer 86 acts as an electrically insulating (non-conductive) layer. In addition, the applicant has appreciated that the BCB layer 86 advantageously allows for some deformation, enabling a more forgiving fit (upto ±10 μm) between the etched bottom silicon wafer 80 and the silicon wafer 84. This in turn advantageously allows for higher production yields with more consistent results.

Other possible substitutes adhesive layers may however, be used in place of a Cyclotene adhesive layer 86, including silicon dioxide. Silicon dioxide and heat bonding may be used to fuse the silicon top wafer 84 to the etched silicon bottom wafer 80. This however, requires both surfaces to be joined to be very precisely machined to achieve proper hard-surface to hard-surface contact. In addition, silicon dioxide is less preferred, as following the joining of wafers 80,84, the silicon dioxide must be dissolved and drained from each resultant CMUT transducer air gap 42 cavity. This typically necessitates a further requirement to drill drain holes through each diaphragm membrane 44 which could later result in moisture and/or contaminants entering the transducers 20, leading to failure.

Following mounting of the silicon top wafer 84 on to the silicon bottom layer 80, the top wafer layer 84 is laser ablated to the desired finish thickness to achieve the membrane diaphragm, and preferably to a thickness of between 0.1 to 5 nm, and which has flat uppermost surface. The final thickness of the top wafer layer 84 will be selected having regard to frequency range (thinner=lower frequency) of the output beam signal.

After laser ablating a chromium interface layer 88 is photoplated onto the top surface of the silicon wafer 84 and the backing layers are then removed. Optionally, the fused wafer assembly is thereafter cut to a desired module size having a desired number of individual transducers (i.e. 40×40). The conductive gold layer 38 is then photo-printed onto the chromium layer 85 on the diaphragm wafer 84. The conductive gold layer 38 provides electric conductivity from the frequency generator 70 to the metal deposit layer 50 formed on the sensor backing platform 18. Where the sensor assembly 14 is to be provided with individually actuatable columns of transducers 20 $S_1, S_2 \ldots S_{40}$, after photo-printing of the gold layer 38, the layer 38 is thereafter selectively etched to remove and electrically isolate the portions of the layer, leaving behind the conductive gold wire bonding $W_1, W_2 \ldots W_{40}$, which provide the electrical conductivity to the associated columns of transducers $S_1, S_2 \ldots S_{40}$. In one embodiment, the completed CMUT microarray 16 is thereafter ready for direct robotic mounting on the coated metal surface 50 of the backing platform 18 by the use of an electrically conductive adhesive In an alternate mode of manufacture, the bottom of the etched bottom silicon wafer 80 is mounted directly on an electrically conductive base (not shown). In one design, a single base may be provided which is made entirely of a conductive metal, such as copper or gold.

Figure 14:
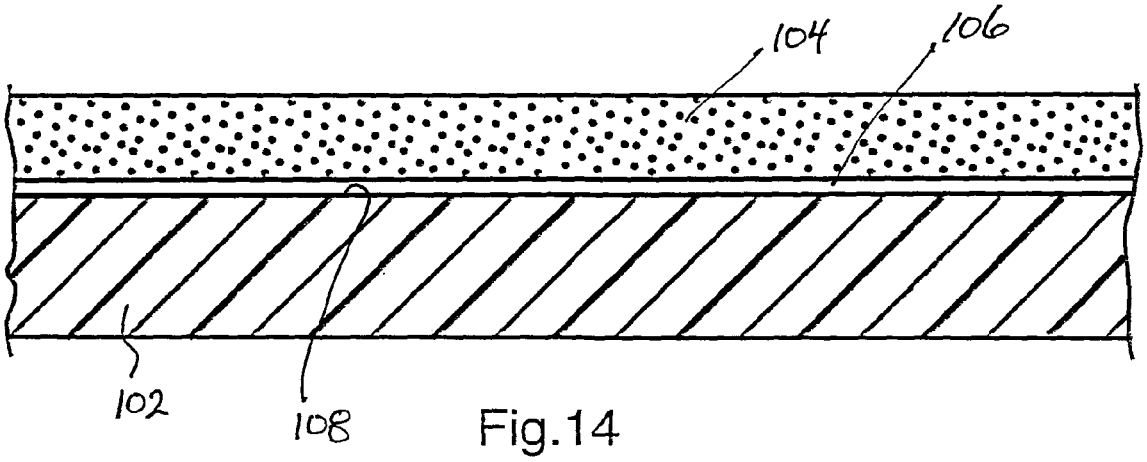
FIG. 14 illustrates schematically the initial application of BCB layer on a bottom silicon wafer construct used in manufacture of the CMUT microarray module of FIG. 5.
Figure 15:
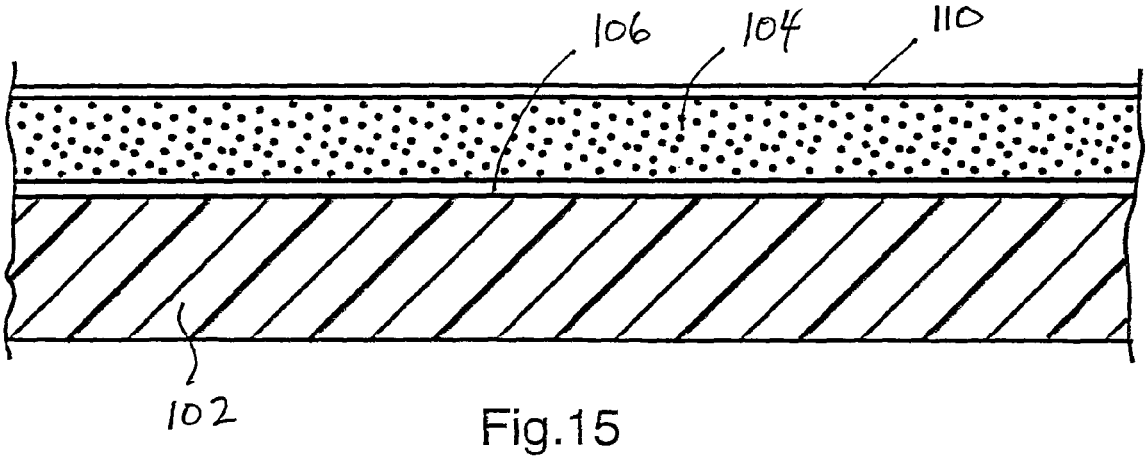
FIG. 15 illustrates schematically the application of a top photoresist layer on the applied BCB layer illustrated in FIG. 14.
Figure 16:
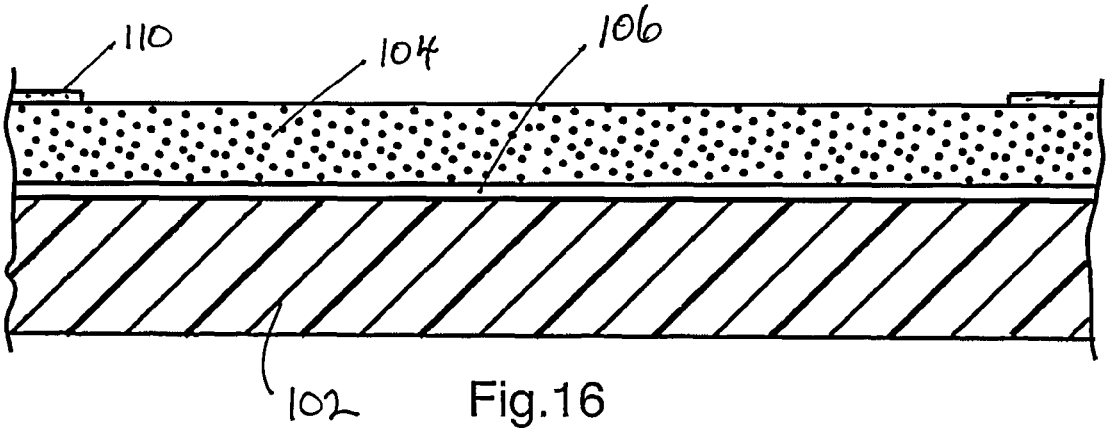
FIG. 16 illustrates schematically the partial removal of the photo-resist layer shown in FIG. 15 in a preparation of BCB layer etching.
Figure 17:
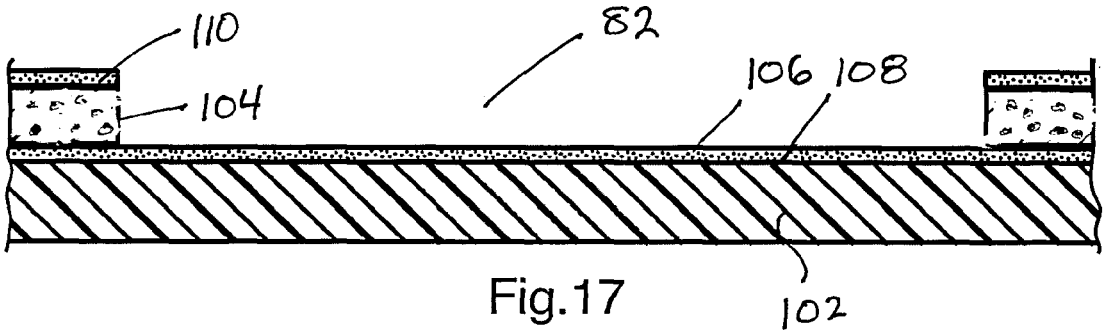
FIG. 17 illustrates schematically the partial etching of the BCB shown in FIG. 14, and the subsequent application of an adhesive promoter layer.

Yet another mode of manufacture described with reference to FIGS. 5 and 14 to 19, is performed as step-by-step fabrication process, in which each cavity or pocket 82 used to form each transducer air gap 42 is formed by removing portions of a BCB intermediate layer 104 which has been secured to a silicon bottom wafer layer 102. In such manufacture, the process starts with a 4-inch N type silicon wafer 102 as the base (FIG. 14). The silicon wafer 102 is heavily doped with Antimony to achieve resistance in the range of 0.008 to $0.02\Omega\cdot cm^2$.

A 900 nm thick BCB layer 104 is then spin deposited over the silicon base wafer, using a 1 nanometer layer 106 thickness of AP3000™ as an adhesive promoter layer. To prepare the surface for BCB coating, the adhesion promoter solution layer 106 is applied to the top surface 108 of the silicon wafer 102 and then spun dry. The resulting layer surface 106 is then immediately ready for BCB coating.

A 0.5 micrometer thickness Shipley 1805 photoresist layer 110 (FIG. 15) is next spin deposited on to the BCB layer 104. After soft baking of the photoresist (150° C.), the wafer is exposed to UV light to carry out photolithography and remove the desired parts of the layer 110 where pockets 82 are to be formed and expose the BCB layer 104. The BCB layer 104 is then dry etched using $CF_4/O_2$ in a ICP (Inductively Coupled Plasma) reactor to form the pockets 82 in the pattern and orientation of the desired transducer air gap 42 configuration to be included in the microarray module 16.

Figure 18:
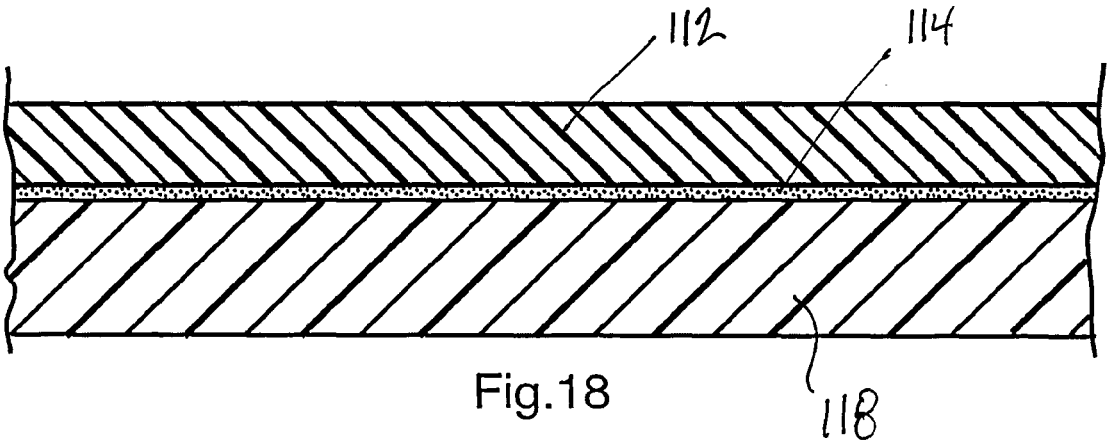
FIG. 18 illustrates schematically the formation of the top silicon wafer layer for use as the membrane diaphragm.
Figure 19:
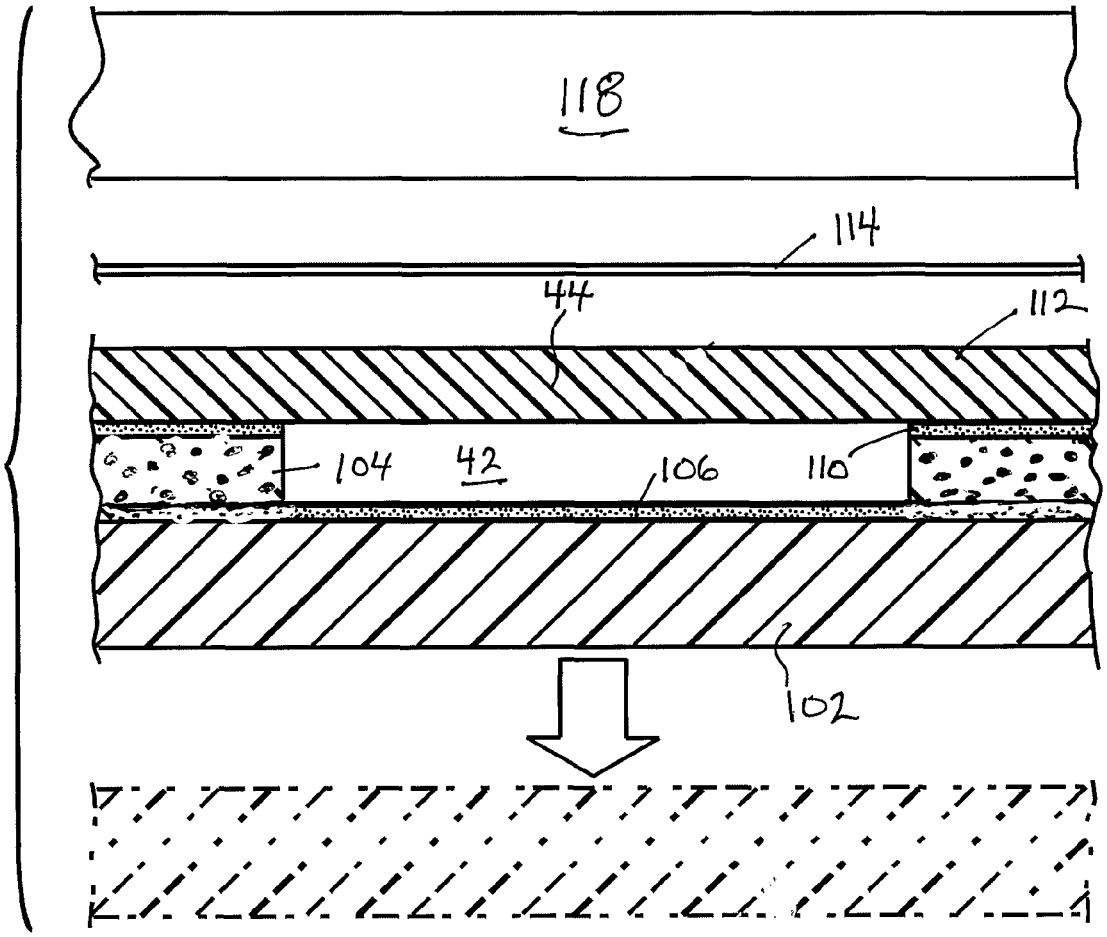
FIG. 19 shows a partially exploded view illustrating the placement of the top wafer layer over the etched BCB layer.

FIG. 18 illustrates the manufacture of a top SOI silicon covering wafer 112 which is to function as a transducer diaphragm membrane 44. To form the top wafer 112, a 1 nm thick AP3000 layer 114 is deposited between a silicon top wafer layer 112 (optionally doped with Antimony) having a thickness of 0.8 μm, and a further 200 nm thick BCB holder layer 118. The holder layer 118 is used in the positioning of the top wafer 112 as a cover. In the BCB layer 118 Cyclotene 3022-35 is most preferably used and diluted by adding mesitylene (C9H12).

In the final design, the active silicon wafer part of the silicon wafer 112 is used as the membrane 44 of each CMUT transducer 20. The base and silicon top wafers 102,112 are then bonded using the layer 104 of BCB as bonding agent. The bonding process is preferably performed at 150° C. to drive out any residual solvents and to allow a maximum bonding strength. Bonded samples are then cured at 250° C. in nitrogen ambient for about 1 hour.

Optionally, one or more further coating layers may be applied to the base and top wafers 102,112 prior to bonding. Suitable coating layers could include gold or other conductive metal coatings.

Following curing, the layer 118 is next removed by dissolving the adhesion product in layer 114 using $CF_4/H_2$, leaving the top silicon wafer.

As a final step, a 100 nm thick gold conductive layer 38 (FIG. 5) is then deposited on to the top membrane wafer 112. In an alternate construction, the gold layer 38 may be spin deposited in place where individual activation of transducers 20 is not critical to the sensor assembly operation.

As a result, the embodiments of the sensor assembly 14 in accordance with preferred embodiment feature one or more of the following:

1. The use or simulation of a 3D transducer configuration to shape and form the sonic beam;
2. An ultrasonic system using CMUT technology that uses or simulate a 3D placement of the CMUT transducers on a simulated hyperbolic paraboloid surface to shape the beam;
3. The control of beam shape is controlled by the design and shape of the hyperbolic paraboloid shape of the chip, and which in turn controls the overall width of the beam, with the flatter the surface the wider the beam;
4. A hyperbolic paraboloid shape which limits the size and effect of minor lobes, thus producing less interference;
5. With the CMUT transducers it is possible to achieve greater signal pressures in both sending and receiving function;
6. Each CMUT transducer may be operated individually, in selected groupings; and/or all at the same time thus providing extensive capability of beam steering and object location within the beam; and
7. The CMUT transducer design is smaller thus allows more transducers placed on every level thus more signal strength and resolution.

While the detailed description descries the transducers 20 in each microarray module 16 as being electrically connected in a vertical strip configuration, the invention is not so limited. Other manner of coupling transducers 20 will also be possible. While not limiting, it is envisioned that a next generation, groupings of electrically coupled transducers could be oriented in both vertical strips as well as horizontal strips to allow for frequency adjustment in two directions.

While the monitoring system 12 in one preferred use is provided in vehicle blind-spot monitoring, it is to be appreciated that its application are not limited thereto. Similarly, the detailed description describes the capacitive micromachined ultrasonic transducer-based microarray modules 16 as being used as in automotive sensor 14, the invention is not so limited. It is to be appreciated that microarrays manufactured in accordance with the present methods and designs which will have a variety of applications including. This include without restriction, applications in the rail, marine and aircraft industries, as well as for use in association with various household applications and in consumer goods.

While the description describes various preferred embodiment of the invention, the invention is not restricted to the specific constructions which are disclosed. Many modifications and variations will not occur to persons skilled in the art. For a definition of the invention, reference may be made to the appended claims.

I claim:

1. A method of forming a capacitive micromachined transducers (CMUT) microarray comprising a plurality of transducers, said method comprising, providing a first silicon wafer having generally planar, parallel top and bottom surfaces, said first wafer having a thickness selected at between about 300 and 500 microns, photo-plasma etching said top surface of the first wafer to form a plurality of pockets therein, each of said pockets having a common geometric shape, each of said pockets characterized by a respective sidewall extending generally normal to said top surface and extending to a depth of between about 0.2 and 5 microns, providing a second silicon wafer having generally planar, parallel top and bottom surfaces, said second wafer having a thickness selected at between about 0.05 and 5 microns, and preferably 0.2 and 2 microns as a device layer, contiguously sealing the bottom surface of the second wafer over the top surface of the first wafer to substantially seal each pocket as a transducers air gap, applying a conductive metal layer to at least part of at least one of the bottom surface of the first wafer and the top surface of the second wafer.

2. The method as claimed in claim 1, wherein the step of applying the metal layer comprises coating a layer of a metal selected from the group consisting of gold, silver and copper, wherein said conductive metal layer has a thickness selected at between about 50 and 500 nanometers, and preferably about 100 nanometers.

3. The method as claimed in claim 1, wherein said common geometric shape comprises a generally square shape having a lateral dimension selected at between about 15 and 200 microns.

4. The method as a claimed in claim 3, wherein said step of forming said pockets comprises forming said pockets in a generally square matrix, wherein groupings of said pockets are aligned in a plurality parallel rows and/or columns.

5. The method as claimed in claim 4, wherein said step of applying said conductive metal layer comprises coating substantially the entirety of the bottom of the first wafer or the top of the second wafer, and wherein after coating, selectively removing portions of said conductive metal layer to electrically isolate at least some of said groupings from adjacent groupings.

6. The method of claim 5 further comprising electrically connecting said groupings to a switching assembly, operable to selectively electrically couple said groupings to a frequency generator.

7. The method of claim 1, wherein said step of sealing comprises applying a BCB layer to the bottom of the second wafer, said BCB layer having a thickness selected at between about 0.5 and 1 microns, and preferably about 0.8 microns, and positioning said BCB layer in a juxtaposed contact with the top surface of the first wafer.

8. The method as claimed in claim 1, wherein said step of forming said pockets comprises forming a square array of at least one hundred pockets, and preferably at least five hundred, each of said pockets having a generally flat bottom.

9. The method as claimed in claim 1 further wherein prior to said etching, mounting said second silicon wafer to a handle wafer, and grinding said wafer to said thickness.

10. The method of manufacturing a capacitive micromachined ultrasonic transducers (CMUT) based assembly sensor, said method comprising, providing a sensor backing platform, said backing platform including a generally square mounting surface having a width selected at between about 0.5 and 10 cm, providing a plurality CMUT transducer microarrays modules comprising a plurality of transducers, each microarray modules having a generally geometric shape and having an average width of between about 1 mm and 2 mm, said microarray being formed by, providing a first silicon wafer having planar, generally parallel top and bottom surfaces, said first wafer having a thickness selected at between about 400 and 500 microns, applying a BCB adhesive layer to at least one of the first wafer top surface and the second wafer bottom surface, positioning the bottom surface of the second wafer over the surface of the first wafer to seal each said pockets as a respective transducer air gap and provide substantially contiguous seal therebetween, and applying a first conductive metal layer to at least part of at least one of the bottom surface of the first wafer and the top surface of the second wafer, applying a second conductive metal layer to either the mounting surface or the one of the bottom surface of the first wafer and the top surface of the second wafer without the first conductive metal layer, and mounting the one of the bottom surface of the first wafer and the top surface of the second wafer without the first conductive metal layer on said mounting surface.

11. The method of claim 10, wherein said step of mounting comprises mounting said CMUT transducer microarrays modules to said backing platform in a generally square array.

12. The method of claim 10 further comprising forming said backing platform from ABS having a generally flat module mounting surface.

13. The method of claim 10 further comprising forming said backing platform with a discretized hyperbolic paraboloid mounting surface, said hyperboloid paraboloid mounting surface including a plurality of discrete planar surfaces for receiving an associated one of said microarray modules thereon, and and further mounting said CMUT transducer microarray modules on the associated ones of said planar surfaces.

14. The method of claim 12, wherein said forming step comprises forming said backing platform on the three-dimensional printer.

15. The method of claim 10, wherein the step of applying the first metal conductive layer comprises spin coating a layer of a metal selected from the group consisting of gold, silver, and copper, wherein said first conductive metal layer has a thickness selected at between about 100 and 500 nanometers, and preferably about 100 nanometers.

16. The method of claim 10, wherein said common geometric shape comprises a generally square-shape having a lateral dimension selected at between about 15 and 200 microns.

17. The method as claimed in claim 16, wherein said step of etching said pockets comprises plasma etching said pockets in an array of generally square or rectangular matrix, wherein said transducers in each microarray module are aligned in a plurality parallel rows and columns.

18. The method claim 17, wherein said step of applying said first conductive metal layer comprises coating substantially the entirety of the bottom of the first wafer or the top of the second wafer, and wherein after coating; selectively removing portions of said first conductive metal layer to electrically isolate said groupings from adjacent groupings.

19. The method of claim 18 further comprising electrically connecting said groupings to a switching assembly operable to selectively electrically connect the transducers in each said grouping to a frequency generator, the frequency generator operable to actuate said transducers to output a beam at a frequency of about 150 to 163 kHz.

20. The method of claim 10, wherein the ultrasonic sensor assembly comprises a vehicle park assist or a blind-spot sensor.

21. The method of claim 10, wherein said sensor assembly includes at least twenty-five said CMUT transducer microarray modules each said CMUT microarray modules comprising a generally square array of at least 4000 transducers.

22. An ultrasonic sensor system for transmitting and/or receiving a sensor beam, the system including a frequency generator and a sensor assembly comprising, a backing, a plurality of capacitive micromachined ultrasonic transducer (CMUT) microarray modules, the microarray modules having a generally square configuration and being disposed in a square-grid matrix orientation on said backing, each said microarray including, a plurality of transducers having a transducer air gap and a diaphragm member, the microarray module comprising:

a bottom silicon layer having a generally planar top surface and a plurality of square shaped pockets formed in said top surface, said pockets each respectively defining sides and a bottom of an associated transducer air gap and being oriented in a generally square shaped array and having a depth selected at between about 0.2 and 1.5 microns, and a width selected at between 15 and 200 microns, and a top silicon layer overlying said planar top surface, the top silicon layer sealing each said pocket as an associated transducer diaphragm member and having a thickness selected at between about 0.2 and 2 microns, and a BCB adhesive layer interposed between a bottom of said top silicon layer and said top surface of said bottom silicon layer, at least one first electrically conductive member, electrically connected to one or more of said transducer diaphragm members, at least one second electrically conductive member interposed between said backing and a bottom of said bottom silicon layer, the at least one first conductive member being electrically connectable to a ground and said frequency generator.

23. The sensor system as claimed in claim 22, wherein the sensor assembly includes a plurality of said first electrically conductive members, said first electrically conductive members each electrically connecting an associated grouping of said transducers in each CMUT microarray, and further including a switching assembly activatable to selectively connect said frequency generator to one or more of said first electrically conductive members to selectively activate said associated groupings of transducers.

24. The sensor system as claimed in claim 22, wherein each of the first and second conductive members comprise a conductive metal coating.

25. The sensor system as claimed in claim 22, wherein each said grouping comprises a columnar grouping of transducer.

26. The sensor system as claimed in claim 22, wherein said square shaped array comprises an array of at least 4000 pockets.

27. The sensor system as claimed in claim 22, wherein the sensor assembly comprises a programmable vehicle park assist or blind-spot sensor.

28. The sensor system as claimed in claim 22, wherein the transmitted beam has a frequency selected at between about 150 and 163 kHz.

* * * * *